US008479955B2

(12) United States Patent
Vesborg et al.

(10) Patent No.: US 8,479,955 B2
(45) Date of Patent: Jul. 9, 2013

(54) MODULE FOR A MODULAR BEVERAGE DISTRIBUTION SYSTEM

(75) Inventors: Steen Vesborg, Gentofte (DK); Jan N. Rasmussen, Olstykke (DK)

(73) Assignee: Carlsberg Breweries A/S, Copenhagen (DK)

( * ) Notice: Subject to any disclaimer, the term of this patent is extended or adjusted under 35 U.S.C. 154(b) by 371 days.

(21) Appl. No.: 12/674,358

(22) PCT Filed: Aug. 19, 2008

(86) PCT No.: PCT/DK2008/000291

§ 371 (c)(1),
(2), (4) Date: Feb. 19, 2010

(87) PCT Pub. No.: WO2009/024147

PCT Pub. Date: Feb. 26, 2009

(65) Prior Publication Data

US 2010/0276452 A1 Nov. 4, 2010

(30) Foreign Application Priority Data

Aug. 20, 2007 (EP) ..... 07388059

(51) Int. Cl.
*B67D 7/06* (2010.01)

(52) U.S. Cl.
USPC ..... 222/146.6; 222/144.5; 222/105; 222/129

(58) Field of Classification Search
USPC ..... 222/183, 146.6, 144.5, 105, 394, 222/399, 6; 239/146
See application file for complete search history.

(56) References Cited

U.S. PATENT DOCUMENTS 2,176,580 A * 10/1939 Buttner ..... 222/6
3,305,136 A * 2/1967 Harris ..... 222/129.1

(Continued)

FOREIGN PATENT DOCUMENTS

WO WO91/10615 7/1991
WO WO2007/019853 2/2007

OTHER PUBLICATIONS

International Search Report on related PCT application (PCT/DK2008/000291); International Searching Authority (EPO) dated Sep. 16, 2009.

*Primary Examiner* — Kevin P Shaver
*Assistant Examiner* — Christopher Bahr
(74) *Attorney, Agent, or Firm* — Klein, O'Neill & Singh, LLP

(57) ABSTRACT

The present invention relates to a module (28) for a modular pressure distribution system (8) comprising a plurality of modules. The module (28) comprises a frame (60, 60', 61, 61') defining an outer periphery and a space defined within the outer periphery and a pressure chamber (22) for receiving a beverage container (68), the pressure chamber being arranged within the space. The module further comprises a first type connector (46) and a second type connector (48) positioned at the outer periphery. A fluid path (47) establishes fluid communication from the first type connector to the second type connector. The first type connector (46) is connectable to a connector of the second type connector (48) of a neighbouring module, and the first type connector is adapted to receive a pressure-fluid from a pressure-fluid source. The second type connector is adapted to transfer the pressure-fluid to a first type connector of a neighbouring module. The module still further comprises a third type connector (66) in fluid communication with the first type connector and supplying the pressure-fluid to the pressure chamber (22).

20 Claims, 17 Drawing Sheets

U.S. PATENT DOCUMENTS 3,464,591 A * 9/1969 Nicola ..... 222/30
3,625,399 A * 12/1971 Heisler ..... 222/56
3,847,173 A * 11/1974 Hill ..... 137/110
3,880,330 A * 4/1975 Leas et al. ..... 222/136
3,976,227 A * 8/1976 Ray ..... 222/136
4,094,445 A * 6/1978 Bevan ..... 222/1
4,531,656 A * 7/1985 Nitchman et al. ..... 222/131
4,932,561 A * 6/1990 Boxall ..... 222/54
4,941,593 A * 7/1990 Hicks et al. ..... 222/148
5,009,082 A * 4/1991 Abraham, III ..... 62/390
5,240,144 A * 8/1993 Feldman ..... 222/82
5,363,671 A * 11/1994 Forsythe et al. ..... 62/197
5,555,997 A * 9/1996 Nogles ..... 220/567.3
6,554,207 B2 * 4/2003 Ebberts ..... 239/146
7,779,856 B2 * 8/2010 Adams et al. ..... 137/210
8,028,857 B2 * 10/2011 Rasmussen ..... 222/1
8,109,115 B2 * 2/2012 Pippia et al. ..... 62/378
2002/0100816 A1 * 8/2002 You ..... 239/71
2004/0011828 A1 * 1/2004 Van Der Klaauw et al. .. 222/527
2007/0157656 A1 * 7/2007 Hall, Sr. ..... 62/389
2010/0176147 A1 * 7/2010 Segers ..... 222/1

* cited by examiner

MODULE FOR A MODULAR BEVERAGE DISTRIBUTION SYSTEM

CROSS-REFERENCE TO RELATED APPLICATION

This application is a national phase filing, under 35 U.S.C. §371(c), of International Application No. PCT/DK2008/000291, filed on Aug. 19, 2008, the entire contents of which are hereby incorporated by reference.

FEDERALLY SPONSORED RESEARCH OR DEVELOPMENT

Not Applicable

BACKGROUND

The present invention relates to a module for a modular beverage distribution system and a modular beverage distribution system comprising a plurality of modules, a pressure-guarding unit and a dispensing valve.

In settings where carbonised or carbonated liquids such as beer, including draught beer or carbonated soft drinks are to be sold as well as non-carbonised liquids such as wine and fruit juice or water, there is a need for a modular beverage distribution system where capacity may be expanded or reduced gradually or stepwise. The present invention provides a module for uses in such a modular beverage distribution system, a modular beverage distribution system and a pressure-guarding unit and a dispensing valve.

Related art may be found in patent publications such as WO 07/019848, WO 07/019849, WO 07/019850, WO 07/019851 and WO 07/019852. Reference is made to the above patent publications, and all are hereby incorporated in the present specification by reference in their entirety for all purposes.

SUMMARY

A first aspect of the present invention relates to a module for a modular beverage distribution system comprising a plurality of modules, the module comprising:

- a frame defining an outer periphery and a space defined within the outer periphery,
- a pressure chamber for receiving a beverage container, the pressure chamber arranged within the space,
- a first type connector and a second type connector positioned at the outer periphery, a fluid path establishing fluid communication from the first type connector to the second type connector, the first type connector connectable to a connector of the second type connector, the first type connector adapted to receive a pressure-fluid from a pressure-fluid source, the second type connector adapted to transfer the pressure-fluid to a first type connector of a neighbouring module, and
- a third type connector in fluid communication with the first type connector and supplying the pressure-fluid to the pressure chamber.

The module according to the first aspect of the present invention is preferably used for storing and holding a replaceable beverage container. The beverage container may be connected to a dispensing line or supply line, which lines do not need to be directly coupled to the frame of the module.

A valve or connector may be provided or mounted in the frame for establishing fluid communication between the beverage container and a dispensing line. The dispensing line may be connected to a dispensing station, e.g. a dispensing tap, where a person, such as a bartender, may selectively dispense beverage from the beverage container. The dispensing station may be of a type with a handle and a dispensing tap. The beverage is preferably draught beer.

The module according to the first aspect of the present invention may define an overall rectangular geometry at a cross-section of the frame, as discussed below. The outer periphery of the frame should preferably be formed so that a plurality of modules may be positioned in series close to each other or in actual facial contact. In this way a plurality of such modules may be interconnected such that incoming pressure fluid from the first type connector of the module may advance via the second type connector to a first type connector of a neighbouring module.

Preferably, the module further comprises a valve at the second type connector, so that the pressure fluid does not exit through the second type connector if no neighbouring module is present at the second type connector, i.e. if the second type connector is not in fluid communication with a first type connector of a neighbouring module. Alternatively, a lid or other closure means may be provided to end the transmission of pressure fluid.

The first and second type connectors should be formed so that they may engage or interlock or connect. The first and second type connectors may e.g. be formed as male and female connectors or other inter-engaging couplings. The size of the openings in the first and second type connectors should allow the mentioned pressure fluid to pass at a sufficiently high pressure and flow rate.

The third type connector is preferably positioned in the interior of the frame, and should be in fluid communication with the first type connector.

The first and second type connectors need not be positioned in registration on the frame. In some situations, however, it may be advantageous that the first and the second type connectors are positioned in such a way that when two neighbouring modules are assembled or connected, the first type connector from one module is easily connected to the second type connector of the neighbouring module. This may be achieved by the first and the second type connector on each module being positioned in registration, i.e. on a geometric line following the direction of fluid advance going through the centre of each of the first and second type connectors and the line being perpendicular in relation to the normal direction of the respective walls whereon the first and the second type connector are positioned.

A direct fluid transmission line is provided between the first and the second type connector. A valve may be positioned and connected to the third type connector so that when a beverage container is disconnected, e.g. to be replaced when empty, the valve ensures that pressure fluid is still supplied to neighbouring modules and prevents any pressure fluid to escape through the third type connector when the beverage container is disconnected.

In an advantageous embodiment of the present invention the frame comprises a first sidewall and a parallel second sidewall, each sidewall defining a top and a respective bottom, the parallel sidewalls interconnected by two parallel endwalls interconnecting the top of the first sidewall with the top of the second sidewall and the bottom of the first sidewall with the bottom of the second sidewall, the two parallel sidewalls and the two parallel endwalls defining the outer periphery and a corresponding inner periphery, and the third type connector may be positioned at the inner periphery.

More advantageously, the sidewalls and/or the two parallel endwalls may be made from a plastic or polymer material, or in the alternative a non-corrosive metallic material such as stainless steel or aluminium.

A second aspect of the present invention relates to a modular beverage distribution system comprising a plurality of modules, wherein each module may comprise:

a frame defining an outer periphery and a space defined within the outer periphery, a pressure chamber for receiving a beverage container, the pressure chamber arranged within the space, a first type connector and a second type connector positioned at the outer periphery, a fluid path establishing fluid communication from the first type connector to the second type connector, the first type connector connectable to a connector of the second type connector, the first type connector adapted to receive a pressure-fluid from a pressure-fluid source, the second type connector adapted to transfer the pressure-fluid to a first type connector of a neighbouring module, and a third type connector in fluid communication with the first type connector and supplying the pressure-fluid to the pressure chamber, a pressure distribution path defined from a first module through each of the plurality of modules, the beverage distribution system further comprising a pressure generator, the pressure generator being in fluid communication with the first module of the plurality of modules via a first type connector of the first module, the pressure generator delivering pressurised fluid to the first module.

Preferably one or more modules as described in relation to the first aspect of the present invention are used for establishing a beverage distribution system according to the second aspect of the present invention. Consequently, all features and advantages etc. mentioned in relation to the first aspect of the present invention apply equally to the modular beverage distribution system according to the second aspect of the present invention.

Throughout the description the term pressure generator/pressure source is used and should be construed as covering both pressure generators such as pumps, air compressors, chemical pressure generators and the like, as well as other pressure sources.

A plurality of modules, such as two, three, four or more modules may be used to establish the modular beverage distribution system. The modules are preferably connected in a series connection. In alternative embodiments a separate connection may be provided to establish parallel connection between modules. The parallel connection may be established by a tube, pipe or other channels.

To ensure that pressure fluid is only transferred from a module when a neighbouring module is present, a valve may be provided at the second type connector. The valve will remain closed when no neighbouring module is present at the second type connector, and will preferably open automatically when attaching a first type connector from a neighbouring module.

The pressure generator may be selected depending on the type of pressure fluid used in the particular system. Preferably one fluid of either water or air is used, but other fluids may be used. Preferably a non-flammable, non-toxic, non-combustible and/or non-volatile fluid is used.

In any event, a pump or air compressor may be used for providing the pressure fluid at a certain pressure level. Alternative pressure generators or pressure sources may be used, such as chemical pressure generators and the like. The pressure level may be determined by the number of modules in a particular set-up. The appropriate pressure level may also change dynamically depending on the amount of beverage left in the beverage containers. The pressure source may be regulated via a sensor or the like to ensure that pressure supplied via the pressure fluid is maintained substantially constant.

A valve may be provided at or in the third connector in order to close off pressure fluid when a beverage container is being replaced.

As mentioned above it is contemplated to be advantageous that the frame comprises a first sidewall and a parallel second sidewall each sidewall defining a top and a respective bottom, the parallel sidewalls interconnected by two parallel endwalls interconnecting the top and the bottom of the first sidewall with a respective top and bottom of the second sidewall, the two parallel sidewalls and the two parallel endwalls defining the outer periphery and a corresponding inner periphery, and the third type connector positioned at the inner periphery.

A rectangular geometry is contemplated to ensure that assembling of modules into a system of modules is easy and possibly that use of space is optimised.

The pressure-fluid may be air or in the alternative pressurised liquid. A further alternative includes CO2.

In an alternative embodiment the frame comprises a sidewall or alternatively a rearwall and a bottom endwall oriented perpendicular to the sidewall/rearwall, the sidewall/rearwall defining a top and a respective bottom, the bottom endwall defining a near end and a distant end, the bottom of the sidewall/rearwall being connected to the near end of the bottom endwall, the endwall defining a near end and a distant end, the sidewall/rearwall and the endwall defining the outer periphery and a corresponding inner periphery, the space being defined between the sidewall/rearwall and the bottom endwall, and the third type connector positioned at the inner periphery.

In the above embodiment the frame constitutes only a rear wall, which is connected to a bottom end wall constituting a base for the frame. The frame thus only partially encapsulates the pressure chamber, which is located in the space defined by the rear plate and the bottom endplate.

In a further embodiment according to the present invention the plurality of modules may be arranged so that the top of the outer periphery of each of the plurality of modules are substantially flush/even and/or co-planar and/or parallel.

The modules in the beverage distribution system should be so arranged that the pressure is delivered from the pressure generator or pressure source to one module at or via the first type connector and is distributed to a neighbouring module via the second type connector of the one module to a first type connector in the neighbouring module. A pressure-fluid path is thereby defined through all modules as a series coupling or connection. Alternatively, the modules may be connected in a parallel coupling, i.e. having a separate pressure fluid path from the pressure generator to each module, or yet alternatively as a combination of series and parallel coupling such as a matrix coupling. The above applies as well for the dispensing line. Consequently, one dispensing line may be provided for each module, or alternatively a common dispensing line for all modules or a combination of the above.

Preferably, the beverage container is a soft or flexible plastic keg for beer or soda. The container may be of a collapsible type wherein the beverage is stored and dispensed as the container collapses. Furthermore, the beverage container may be a keg comprising a flexible bag wherein the bag is compressed by the pressure fluid thereby dispensing the beverage stored in the bag. The pressure chamber is preferably made from a plastic or polymer material or any other suitable material, such as a Kevlar or fibre reinforced material, allowing the pressure chamber to tolerate the pressure generated or accumulated inside the pressure chamber.

The pressure-fluid may further be used as a cooling agent for cooling the beverage in the beverage container. It is contemplated to be advantageous to use the pressure-fluid as a cooling agent or heat transportation means, i.e. for transporting heat away from the beverage stored in the container.

As described above, the beverage distribution system may further comprise a dispensing line or supply line in fluid communication with the beverage container, the dispensing line being in fluid communication with a dispensing tap/station/unit for selectively dispensing beverage. Preferably the beverage distribution system may further comprise a separate supply line for each of the beverage containers, each supply line being in fluid communication with a respective beverage container, each of the supply lines being in fluid communication with a respective dispensing tap for selectively dispensing each beverage. The dispensing lines may be made from a flexible, plastic material, and may have a circular cross-section.

Further advantageously, the pressure chamber may be pivotally mounted in the frame, the pressure chamber being operable between a vertical state and a horizontal state, the vertical state being a dispensing state where the pressure chamber is positioned substantially vertical and in fluid communication with the third type connector, the horizontal state being a position where the pressure chamber is in a substantially horizontal position and lacks fluid communication to the third type connector. This pivotal mount is contemplated to ease change of the beverage container.

More advantageously, the pressure chamber may operate a switch controlling a valve at the third type connector so that when the pressure chamber is in the vertical state, the valve is open and when the pressure chamber is operated away from the vertical state, towards the horizontal state, the valve is closed. This is contemplated to ensure that pressure fluid is not supplied to the pressure chamber when a beverage container is about to be exchanged with a new one.

Preferably the beverage container is rotatably mounted in the pressure chamber. It is contemplated that this is an easy way of securing a beverage container in the pressure chamber. An operator may grab e.g. a handle part of the beverage container and turn or rotate the beverage container mounted in the pressure chamber, e.g. in a clockwise direction, so as to release the beverage container. The new beverage container may then be inserted into the pressure chamber and secured by turning or rotating the beverage container in the opposite direction, e.g. in a counter-clockwise direction.

In certain embodiments the pressure chamber may include a liner, such as a flexible rubber or plastic membrane or liner positioned between the inner wall of the pressure chamber and the beverage container, so that the pressure fluid acts on the rubber or plastic membrane and the pressure force is transferred onto the surface of the beverage container. It is contemplated to be advantageous in embodiments when the pressure fluid used is a liquid. The liner is contemplated to ensure that the pressure fluid does not come in direct contact with the beverage container. It is preferred that the liner forms a tight seal against a rim of the pressure chamber. When pressure fluid, e.g. liquid, is pressed into the pressure chamber, the pressure fluid is present between the inside of the pressure chamber and separated from the beverage container by the liner.

The pressure fluid may be drawn, drained or pumped away from the space or volume between the inside of the pressure chamber and the liner. Preferably, the pressure fluid is removed by pumping the pressure fluid, preferably gas or air, into the interspace between the liner and the outer wall of the beverage container.

A third aspect of the present invention relates to a pressure-guarding unit for use with a module or beverage distribution system as described above. The pressure-guarding unit may comprise

- a first interface connector in fluid communication with a second interface connector, the first interface connector adapted to receive the pressure-fluid, the second interface connector adapted to connect to a first type connector of a module, and
- a pressure regulator mounted between the first interface connector and the interface connector so as to limit pressure supplied from the first interface connector to the second interface connector.

The pressure guarding unit according to the third aspect of the present invention is contemplated to be used as a device for limiting the maximal pressure supplied from the pressure source to one or more modules as described above in relation to the first and/or second aspect of the present invention.

In a particular embodiment of the pressure guarding unit according to the third aspect of the present invention, the pressure-guarding unit is mountable on one of the parallel sidewalls of the module. The unit may be considered as a zero-module or initial module, i.e. the first module in communication with the pressure source such that the pressure source is in communication with the first interface connector which is in fluid communication with the second interface connector via the pressure regulator. The second interface connector is further in fluid communication with the first type connector of a module.

It is contemplated that using a pressure guarding unit according to the third aspect of the present invention will increase the safety of the beverage distribution system by limiting the amount of pressure delivered to the beverage distribution system. The pressure guarding unit limits the pressure to a given maximum, e.g. 3 bars, which ensure that the pressure inside the pressure chamber does not exceed this limit. The limit may be set or chosen on the basis of the strength of the pressure chamber. Embodiments without the pressure guarding unit may still work, but not with the improved safety provided by the pressure guarding unit according to the third aspect of the present invention.

A fourth aspect of the present invention relates to a dispensing valve for use with a beverage container included in a pressure chamber of a beverage distribution system according to the first and/or the second aspect of the present invention, the dispensing valve comprising:

- a valve body defining an inlet constriction being in fluid communication with a beverage outlet of the beverage container, the valve body further defining an outlet constriction located opposite the inlet constriction and the valve body further defining a passage interconnecting the inlet and outlet constrictions, the passage having a transversal dimension larger than the inlet and outlet constrictions,
- a movable sealing element accommodated inside the valve body having a transversal dimension smaller than the passage and larger than the inlet and outlet constrictions, and
- an actuator for moving the sealing element between three specific positions within the valve body, the positions defining:

a first and second position in which the sealing element is contacting the inlet and outlet constrictions, respectively, for preventing fluid communication between the inlet and outlet constrictions, and an intermediate third position in which the sealing element is located between the inlet and outlet constrictions for allowing fluid communication between the inlet and outlet constrictions.

The dispensing valve according to the fourth aspect of the present invention is contemplated to either be a part of the beverage container or alternatively a part of the module as described in connection with the first aspect of the present invention, or yet alternative a part of both. Preferably, the valve body and the sealing element is a part of the beverage container and preferably made of the same disposable materials as the beverage container for being disposed together with the beverage container. The actuator is preferably a non-disposable part of the module made to interact with the sealing element when a beverage container is installed in the module. The actuator is used for shifting the sealing element between a first and a second position constituting sealed positions in which the sealing element seals against the constrictions. Between the sealed positions there exist a dispensing position where the sealing element is located between the constrictions and where beverage from the beverage container is allowed to pass by the sealing element.

In a further embodiment of the dispensing valve, the beverage outlet is positioned at the bottom of the beverage container when the beverage container is received in the pressure chamber. This position eliminates the need of any ascending pipe extending to the bottom of the beverage container for allowing beverage to flow towards the outlet. The position also permits all beverages to be dispensed without any air, since any air pockets within the beverage container will remain at the top of the beverage container. When removing the beverage container with beverage remaining inside the sealing element will prevent any substantial leakage of beverage by moving towards the outlet constriction. The sealing element should thus be made of a light material to be able to move quickly to the outlet constriction by the flow of beverage.

In a further embodiment of the dispensing valve the sealing element is moved from the second position to the intermediate position and from the intermediate position to the first position by the force applied by the actuator and in the opposite direction by the gravity force. The sealing element preferably rests in the second position when the actuator is removed. By activating the actuator, i.e. by the supply of energy to the actuator, the actuator may move the sealing element to any of the intermediate or first positions. The sealing element may preferably be moved in the opposite direction, i.e. from the first position to the intermediate position and from the intermediate position to the second position, by the gravity of either the sealing element itself or the beverage contained in the beverage container or both. Alternatively, a spring may be used to move the sealing element in the opposite direction.

In a further embodiment of the dispensing valve, the beverage outlet is positioned at the top of the beverage container when the beverage container is received in the pressure chamber, the beverage outlet preferably having an ascending pipe extending to the bottom of the beverage container. This position is less preferred since it requires an ascending pipe for avoiding any air to be dispensed from air pockets within the beverage container.

In a further embodiment of the dispensing valve, the sealing element is moved from the second position to the intermediate position and from the intermediate position to the first position by a spring force and in the opposite direction by the actuator. The above embodiment is useful when the outlet is positioned at the top of the beverage container.

In a further embodiment of the dispensing valve, the actuator comprises a piston or rod. Preferably a piston or rod is introduced through the outlet constriction to interact with the sealing element. The piston or rod should be made having a transversal dimension smaller than the outlet constriction to allow fluid to pass.

In a further embodiment of the dispensing valve, the sealing element comprises a ball-seal. The sealing element may preferably have a ball shape to avoid the sealing element being stuck inside the valve body. Most preferably a spherical shape is used, however, alternatively an ellipsoidal shape may be used. Yet another alternative is a cylindrical shape. In certain embodiments other shapes may be used such as an octahedron or tetrahedron or the like. A large transversal movement of the sealing element may cause even a spherical sealing element to get stuck. To avoid any large movement of the sealing element in the transversal direction, the transversal dimension of the sealing element should be made as large as possible, however still small enough for allowing beverage to pass around it in the intermediate position.

In a further embodiment of the dispensing valve, the actuator comprises a pneumatic system and/or a spring and/or an electromechanical system. Preferably, a pneumatic system is used for moving the actuator since high pressurized gas is available as pressure source for the beverage dispensing. A spring may be used as a counter force to move the actuator in an opposite direction. Alternatively an electromechanical system may be used to e.g. act on a magnetic sealing element.

In a further embodiment of the dispensing valve, the outlet constriction is in fluid communication with a dispensing line and a dispensing tap of a beverage distribution system according to the first and second aspect of the present invention, or alternatively any similar beverage distribution system.

In another embodiment of the present invention the dispensing valve comprises a coupling housing being in fluid communication with the outlet constriction, the coupling housing comprising a dispensing outlet, a rinsing fluid inlet and a rinsing seal, the rinsing seal communicating with the actuator for defining:

an open position when the actuator is in the first position in which open position the rinsing seal is allowing fluid communication between the coupling housing and the rinsing fluid inlet, and a closed position when the actuator is in any of the intermediate and second positions in which closed position the rinsing seal is preventing fluid communication between the coupling housing and the rinsing fluid inlet.

After a certain amount of dispensed beverage or alternatively after a certain time period the dispensing valve, tapping line and beverage tap must be rinsed due to reasons of hygiene. For this purpose a coupling housing may be introduced after the dispensing valve to permit either beverage dispensing or rinsing. It is thereby important not to mix rinsing fluid and beverage, therefore rinsing must only be allowed when the beverage container is sealed. Consequently, beverage dispensing must only be allowed when the rinsing fluid inlet is closed. This is achieved by a common actuator controlling both the sealing element and the rinsing seal.

By introducing rinsing fluid into the rinsing fluid inlet when in the open position, rinsing fluid is allowed to proceed through the beverage outlet via the tapping line and through the beverage tap, provided the beverage tap is open. Also, the rinsing fluid may proceed into the tapping valve and passage to clean the passage and the actuator. Inbetween rinsing and beverage dispensing water should be introduced into the rinsing fluid inlet to remove any residual rinsing fluid still inside the beverage distribution system.

The rinsing fluid should be chosen among fluids having proper chemical properties for removing residual beverage from the tapping line, coupling housing and valve body.

In a further embodiment of the dispensing valve, the dispensing outlet is in fluid communication with a dispensing line and a dispensing tap of a beverage distribution system according to the first and/or the second aspect of the present invention, and the rinsing fluid inlet is in fluid communication with a rinsing fluid container for supplying rinsing fluid to the coupling housing. Rinsing fluid is preferably supplied from a pressurized rinsing fluid container through the rinsing fluid inlet via the coupling housing to the beverage outlet, tapping line and beverage tap. When rinsing the beverage tap is opened and rinsing fluid is allowed to proceed through the tapping line and beverage tap. When dispensing beverage, the dispensing outlet is in fluid communication with the beverage container and the rinsing fluid inlet is sealed off.

In a further embodiment of the dispensing valve, the coupling housing may be separable in an upper part fixated to the beverage container and a lower part fixated to the dispensing outlet and rinsing fluid inlet, the actuator and the rinsing seal being accommodated in the lower part. In this way the dispensing valve may be provided and disposed together with the beverage container and the actuator, rinsing seal, beverage outlet and rinsing seal may be non-disposable components of the module. Preferably, the two parts are connected by a thread- or bayonett-mount, such that the upper part together with the beverage container may be removed by a twisting motion.

BRIEF DESCRIPTION OF THE DRAWINGS

The present invention is now to be described in greater detail with reference to the drawings, wherein.

DETAILED DESCRIPTION

Figure 1:
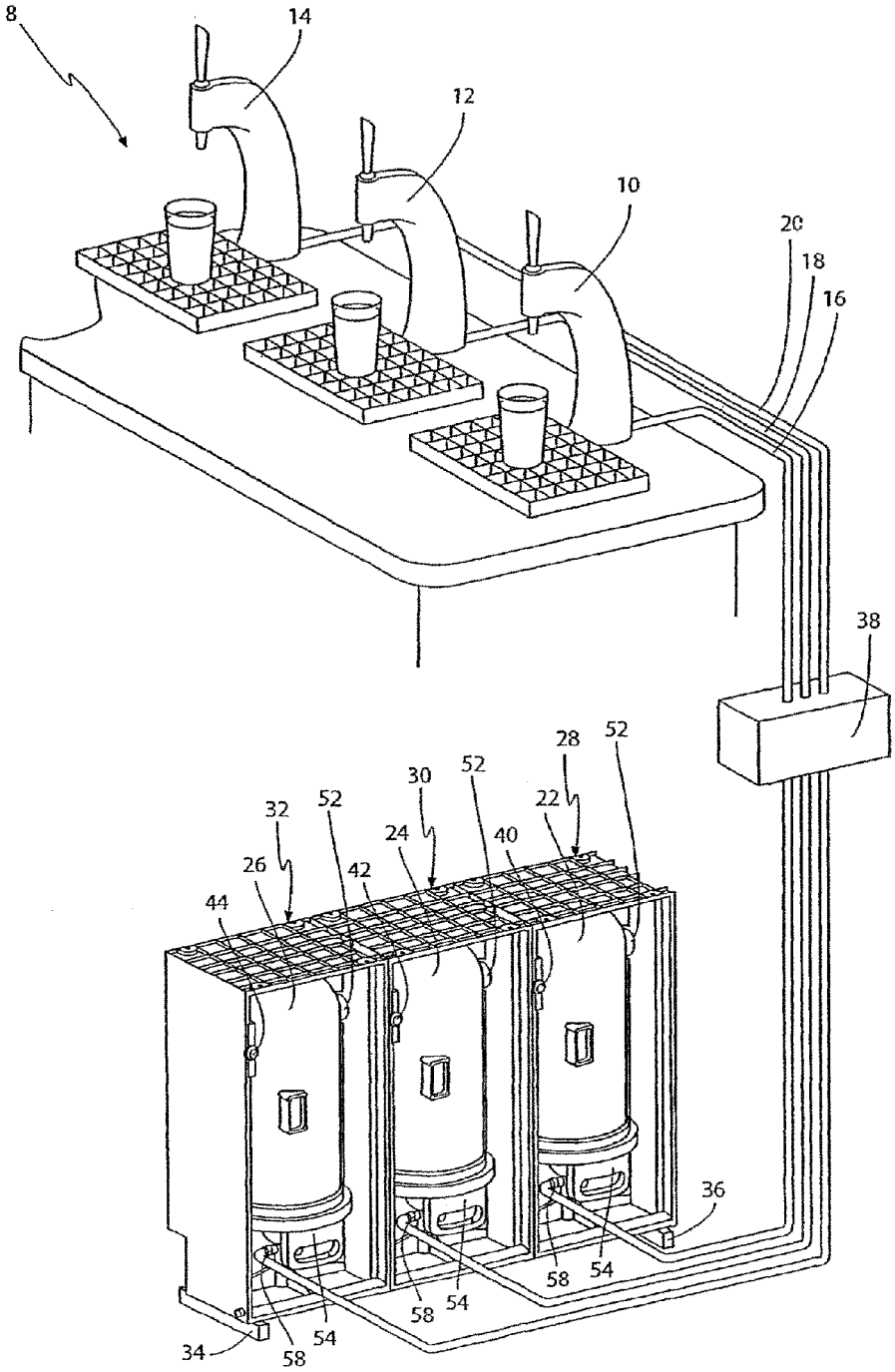
FIG. 1 is a schematic perspective view of a beverage distribution system according to the present invention with three beverage containers and three dispensing taps.

FIG. 1 schematically illustrates a beverage distribution system 8 with three dispensing taps 10, 12 and 14. Each of the dispensing taps 10, 12 and 14 is adapted to selectively dispense beverages, i.e. beer, soda, wine or the like. Each of the dispensing taps 10, 12 and 14 is in fluid communication with a respective supply line 16, 18 and 20, which are in turn in fluid communication with a respective beverage container located inside a pressure chamber 22, 24 and 26 through a respective dispensing valve 58 as described in greater detail in FIG. 5. Alternatively, two or more of the supply lines may be joined to a single dispensing tap through e.g. a switching valve, not shown in the drawing, however, well known in the art per se.

Figure 2:
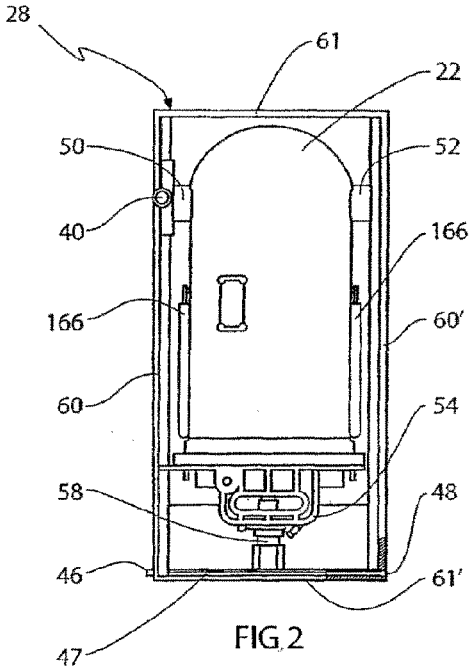
FIG. 2 is a schematic front view of a module with a pressure chamber.
Figure 3:
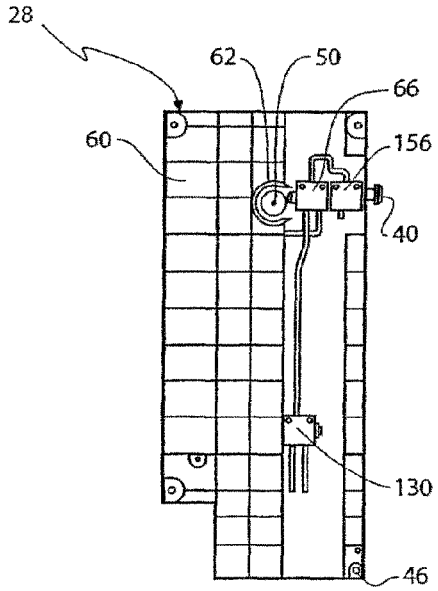
FIG. 3 is a schematic left side view of the module of FIG. 2.
Figure 4:
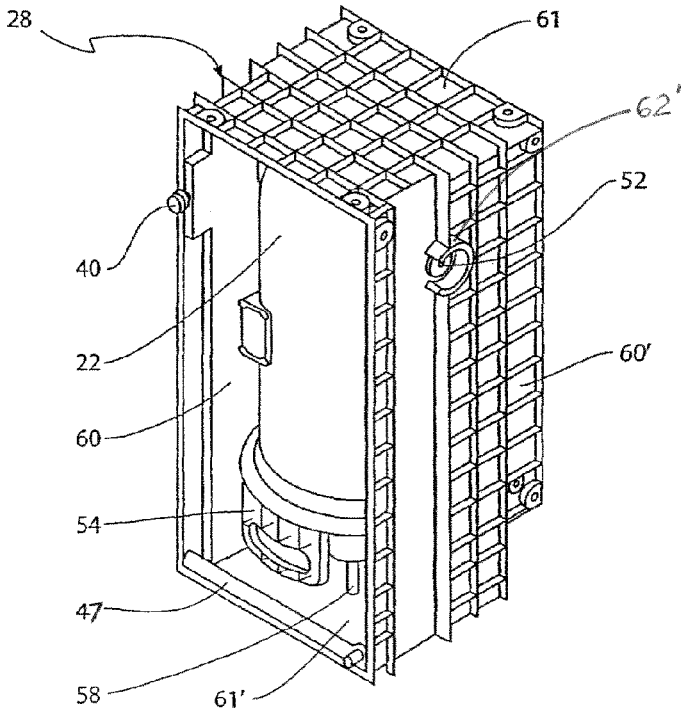
FIG. 4 is a schematic perspective view of the module and pressure chamber of FIGS. 2 and 3.

FIG. 1 schematically illustrates three modules 28, 30, 32 each comprising a frame having two parallel sidewalls 60 and 60' and corresponding parallel top and bottom walls 61, 61' shown in FIGS. 2-4, and a pressure container or a pressure chamber 22, 24, 26. Inside each pressure chamber 22, 24, 26 a beverage container is positioned as will be discussed in greater detail with reference to FIG. 5.

The pressure chambers 22, 24, 26 are pivotally mounted in each module 28, 30, 32 and are manually pivotable by the use of a handle 54. The modules 28, 30, 32 are pivotable around a journaling axis extending through a left-hand and a right-hand journal 50 and 52, respectively. In FIG. 1 only the right-hand journal 52 is visible due to the perspective view. A plurality of modules 28, 30, 32 are assembled as shown in FIG. 1 to form a beverage distribution system 8 wherein the top walls are substantially flush/even or co-planar. The modules 28, 30, 32 are mounted on two supports 34 and 36 for a stable and secure positioning of the modules 28, 30, 32.

The tapping lines or supply lines 16, 18, 20 pass through a cooling system 38 ensuring that the beverages dispensed from the dispensing taps 10, 12, 14 have an appropriate low temperature.

The pressure chambers 22, 24, 26 receive a pressurised fluid from a pressure source, e.g. a pump connected to a fluid reservoir (both not shown in the present drawing but well known in the art per se). In the presently preferred embodiment according to the present invention, the pressurised fluid is either air or water.

Figure 6:
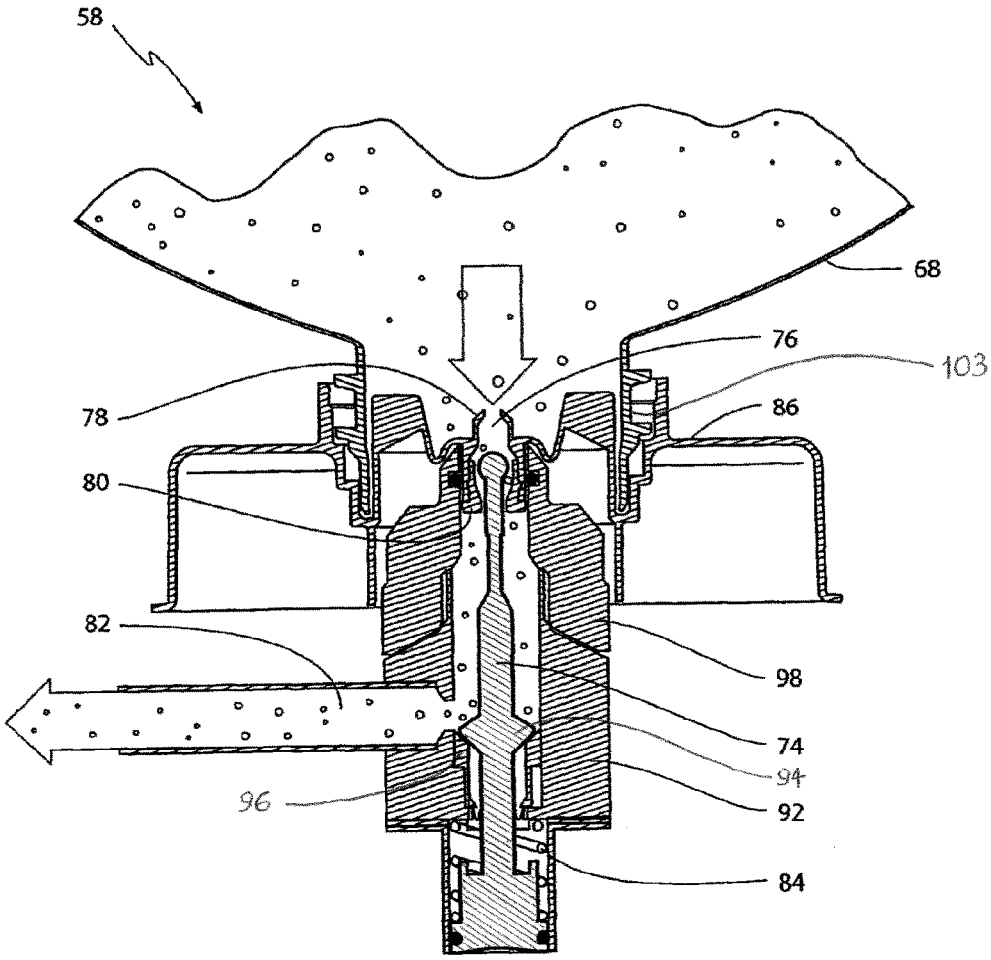
FIG. 6 is a schematic cut-through view of a dispensing valve for use with a beverage container, the dispensing valve being in the beverage dispensing position.
Figure 7:
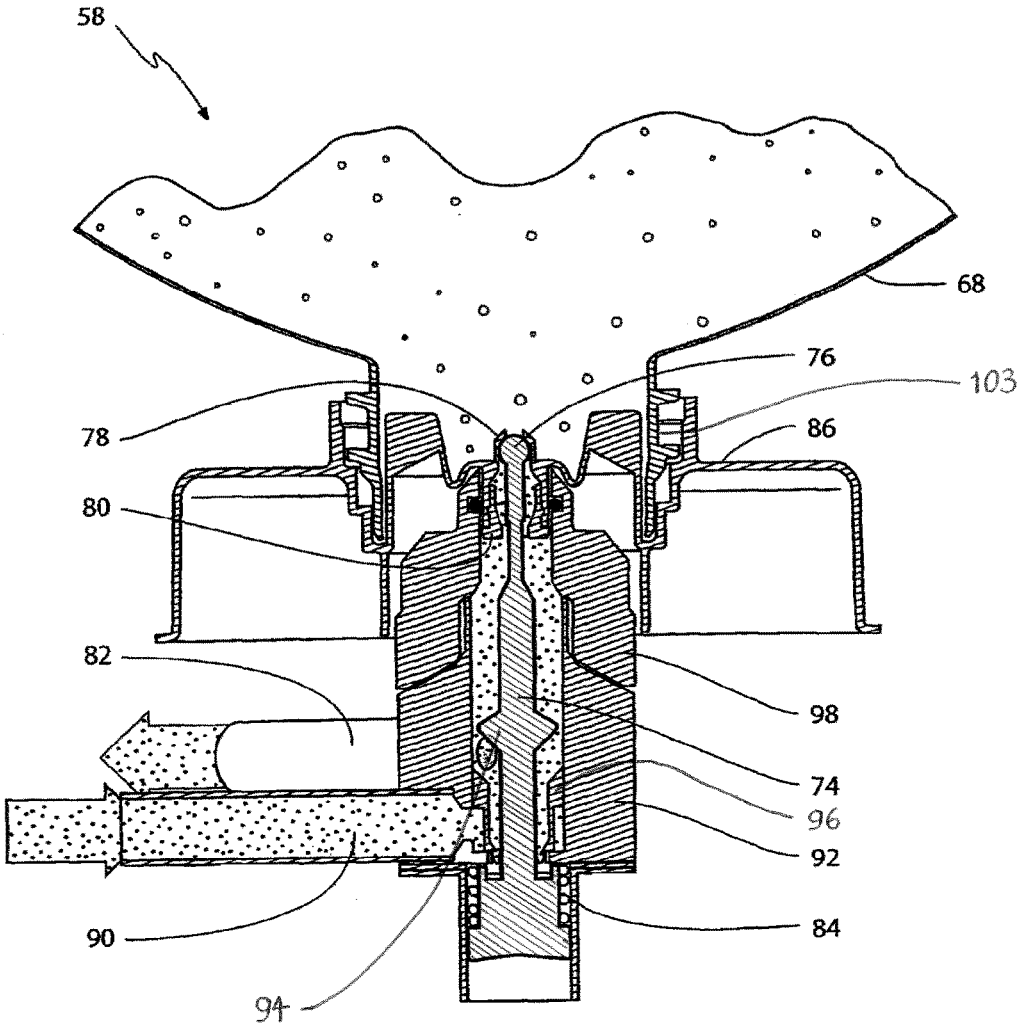
FIG. 7 is a schematic cut-through view of the dispensing valve of FIG. 6 for use with a beverage container, the dispensing valve being in the rinsing position.

The pressure chambers 22, 24, 26 are pivotally mounted in the modules 28, 30, 32, respectively. The pressure chambers 22, 24, 26 are shown in a position where beverage is able to flow from the beverage container. When a beverage container is empty an operator such as a bartender or similar person, may press a button 40, 42, 44 on the front of the module 28, 30, 32. The button 40, 42, 44 is operatively coupled to a dispensing valve 58 as described in FIGS. 2-4 such that when the button 40, 42, 44 is pressed, the dispensing valve 58 closes the supply of beverage from the beverage container, allowing the pressure chamber 22, 24, 26 to pivot from a substantially vertical position shown in FIGS. 1 and 19 to a substantially horizontal position shown in FIG. 20, in which horizontal position the beverage container inside the pressure chamber 22, 24, 26 may be changed. Additionally, a security valve 66, shown in FIG. 3 and in FIGS. 11-16, is operated automatically when pivoting the pressure chamber from the vertical position to the horizontal position. The security valve 66 interrupts the supply of pressure fluid to the pressure chamber and depressurizes the pressure chamber by allowing the pressure fluid to escape to the outside. When pivoting the pressure chamber from the vertical position to the horizontal position the dispensing valve 58 is separated into a lower part fixated to the bottom wall 61 and an upper part fixated to the pressure chamber 22. The lower part comprises a coupling housing 92 and the upper part comprises a ball seal 76 as shown in FIGS. 6-7. The working principle of the dispensing valve 58 and the security valve 66 will be further discussed later in connection with FIGS. 5-10 and 2-4 respectively.

The pressure chambers 22, 24, 26 are made from a polymer material such as plastic. The beverage container located inside the pressure chamber 22, 24, 26 is of a collapsible type, meaning that the beverage container collapses under pressure, thereby causing beverage stored in the beverage container to be expelled or dispensed from the beverage container, which will be described in greater detail later.

FIG. 2 is a schematic illustration of a front view of the module 28 for use in the previously described beverage distribution system 8 having a plurality of such modules 28, 30, 32, or alternatively for use as a stand-alone module 28. The pressure chamber 22 is pivotally mounted in the frame of the module 28. The frame of the module 28 or of each module 28, 30, 32 constitutes sets of opposite sidewalls 60 and 60' and opposite top and bottom walls 61 and 61'. The bottom end 61' of the module 28 further comprises a pressure inlet 46 and a pressure outlet 48, constituting a first type and a second type connector, respectively. Between the pressure inlet 46 and the pressure outlet 48, a fluid path 47 is provided establishing fluid communication between the pressure inlet 46 and the pressure outlet 48. The pressure inlet 46 is to be connected to a pressure source such as e.g. a pump or compressor or to the pressure outlet 48 of an adjacent module 30, the pressure outlet thus acting as a pressure source. The pressure outlet 48 constitutes a check valve, which opens upon connecting the pressure outlet 48 to a pressure inlet 46 of a further module 30 to provide the further module with pressurized fluid. Consequently, the pressure outlet 48 closes upon removing the pressure inlet 46 of the further module to prevent any substantial leakage of pressure fluid through the pressure outlet 48. The pressure inlet 46 is further connected to the security valve 66 (FIG. 3), which provides pressure fluid to the pressure chamber 22 and thus constitutes a third type connector.

The pressure chamber 22 includes as mentioned above a handle 54 for allowing an operator to pivot the pressure chamber 22 and two gas cylinders 166 for maintaining a stable horizontal position. Before an operator is allowed to pivot the pressure chamber 22, the button 40 needs to be operated, as the button 40 is operatively connected to the dispensing valve 58. When the button 40 is operated, the dispensing valve 58 closes so that beverage from the beverage container does not enter the supply line, leading the beverage from the beverage container to the dispensing tap shown in FIG. 1.

FIG. 3 and FIG. 4 are a schematic side view and a perspective schematic view respectively of the module 28 of FIG. 2. A semicircular flange 62 connected to the pressure chamber 22 extends through an opening of the sidewall 60 of the module 28 (shown in FIG. 3). Similarly, in the sidewall 60' shown in FIG. 4, a flange 62' is provided, however constituting a part solidly connected to the sidewall 60'. The flange 62 defines a semi-circle, i.e. it is circular with an open part. The flange 62 is adapted to engage a security switch 64 (as shown in FIGS. 11-16) which controls the security valve 66 which prevents pressure fluid being supplied to the pressure chamber 22 when the pressure chamber 22 is pivoted from the vertical to the horizontal position. When the pressure chamber 22 is pivoted relative to its supporting frame (60, 60', 61, 61') of the module 28, the flange 62 rotates counter-clockwise in relation to FIG. 3.

The button 40 controls a pneumatic valve 156 (FIG. 3), which in turn is controlling the dispensing valve 58 (FIG. 2), such that when the button 40 is pressed, pressure supply is interrupted to the dispensing valve 58. The pneumatic valve 156 is supplied with pressure fluid from the security valve 66. The working principles of the dispensing valve will be further discussed in FIGS. 5-8. In some embodiments an optional release valve 130 is present. The release valve 130 is used to depressurize the pressure chamber 22 slowly through a flow restrictor when pivoting the pressure chamber 22.

Figure 5:
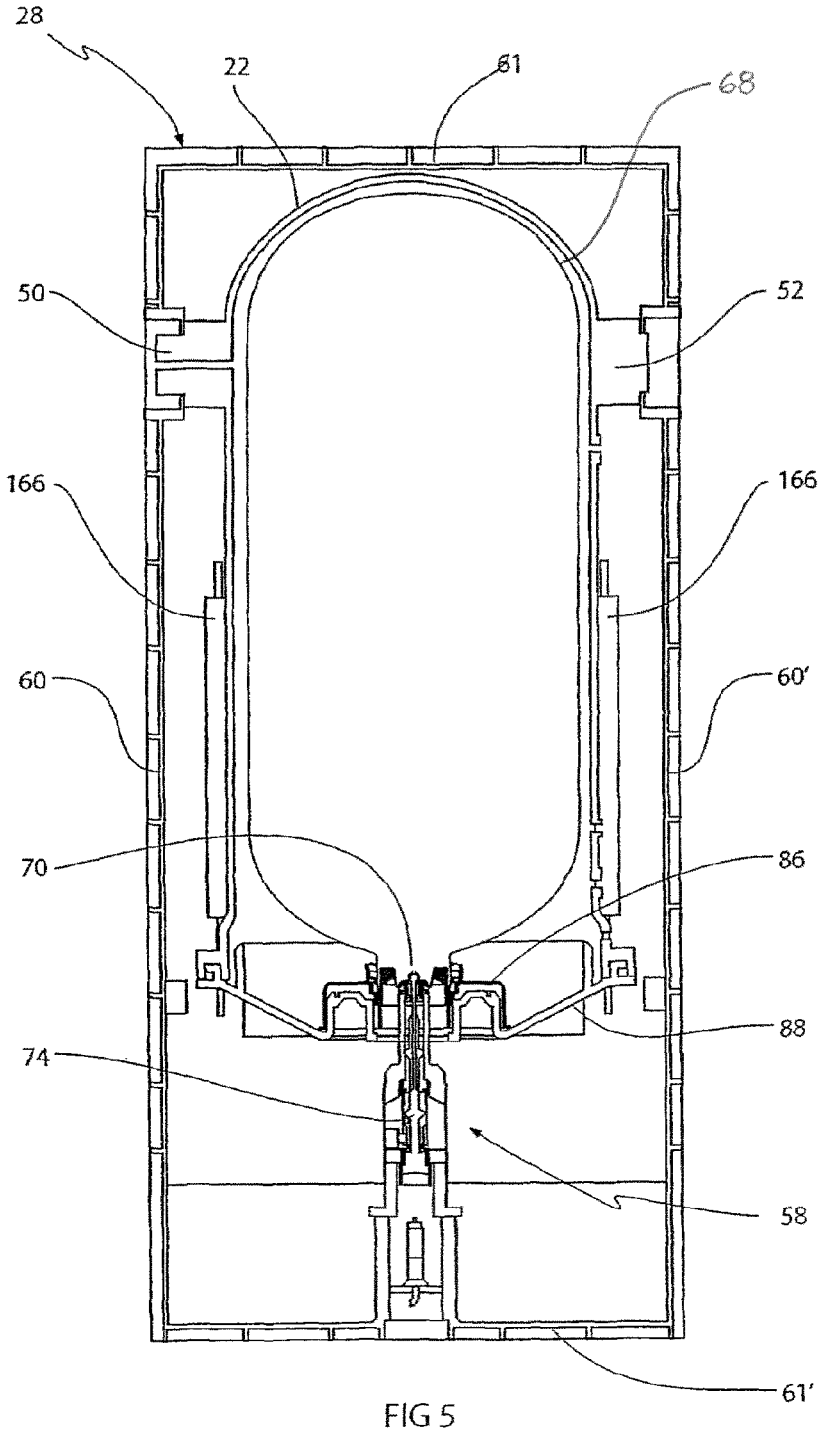
FIG. 5 is a schematic cut-through view of the module and the pressure chamber of FIGS. 2 and 3.

FIG. 5 is a schematic cut-through view of the module 28 and the pressure chamber 22 further disclosing a rod 74 constituting an actuator of the dispensing valve 58 to be described in greater detail below with reference to FIGS. 6 and 7, and a pair of gas cylinders 166 serving to maintain the pressure chamber in the above-mentioned horizontal position. The one end of each of the gas cylinders is connected to the frame (60, 60', 61, 61') and the other end is connected to the pressure chamber. Inside the pressure chamber 22 a beverage container 68 is arranged. The beverage container 68 is of a collapsible type, meaning that a pressure fluid enters the space between the inner walls of the pressure chamber 22 and the outer wall of the beverage container 68. The pressure fluid is supplied from the security valve (FIG. 3) and enters the pressure chamber 22 via a pressure duct, which is located inside the left-hand journal 50. In a steady state condition pressure fluid being either air or water is supplied to the pressure chamber 22. The beverage container 68 has an opening 70, which is in fluid communication with the dispensing valve 58, and a base part 86 surrounding the opening 70 for sealing the beverage container and a pressure lid 88, which constitute the lower end of the pressure chamber. The pressure lid 88 may be removed when the pressure chamber 26 is in the horizontal position for changing the beverage container 68. The base part 86 is shown in detail in FIG. 8B. When the dispensing tap is opened, beverage flows from the beverage container 68 due to the pressure exerted on the wall of the beverage container 68 by the pressure fluid. When an amount of beverage is dispensed, the volume of the beverage container 68 is reduced and part of the wall of the beverage container 68 collapses as a result of the exerted pressure.

FIG. 6 is a schematic cut-through, close-up view of the dispensing valve 58, as illustrated in the above drawings.

The dispensing valve 58 comprises a rod 74, which is located inside the coupling housing 92 and which is adapted to act on a ball-seal 76. The ball-seal 76 is in the present embodiment not a part of the coupling housing 92, but part of the beverage container 68. The ball-seal 76 is received in the base part 86. The dispensing valve 58 is operable between three possible positions, which constitute a first position, an opposite second position and an intermediate position. As will be described in greater detail below, the intermediate position constitutes a beverage dispensing position whereas the first and second positions constitute a rinsing position and a closed position, respectively.

The ball-seal 76 is located in the base part 86 in a defined space between an inlet constriction 78 and an outlet constriction 80. The inlet constriction 78 and the outlet constriction 80 both include an opening or aperture for allowing beverage to flow from the beverage container 68 via the inlet and outlet constrictions 78, 80 and further through the coupling housing 92 towards a beverage outlet 82. Both the inlet constriction 78 and the outlet constriction 80 constitute valve seats which the ball-seal 76 may seal against. The ball-seal 76 will either establish a seal against the inlet constriction 78 or the outlet constriction 80, or remain in the intermediate position, shown in FIG. 6, which constitutes the beverage dispensing position. The coupling housing 92 accommodates the rod 74 and fits to the base part 86. The coupling housing 92 is fixated to the bottom wall (61' in FIGS. 2 and 4) such that when the pressure chamber 22 and the beverage container 68 are swung or pivoted into the horizontal position shown in FIG. 20, the coupling housing 92 including the rod 74 remains with the bottom wall and the dispensing valve 58 including the ball seal 76 remains with the beverage container 68. The rod 74 and the coupling housing 92 may thus be made of rigid and non-disposable materials such as metal. When the pressure chamber is in the vertical position a fitting 98 seals between the base part 86 and the coupling housing. The fitting 98 is shifted downwards to allow the pressure chamber 22 to swing into the horizontal position.

When the rod 74 is in the beverage dispensing position, i.e. in the active or intermediate position as shown in FIG. 6, beverage may flow from the beverage container 68 past the ball-seal 76 and through the beverage outlet 82. The beverage outlet 82 is in fluid communication with the supply line 16, 18, 20 (shown in FIG. 1).

Figure 8B:
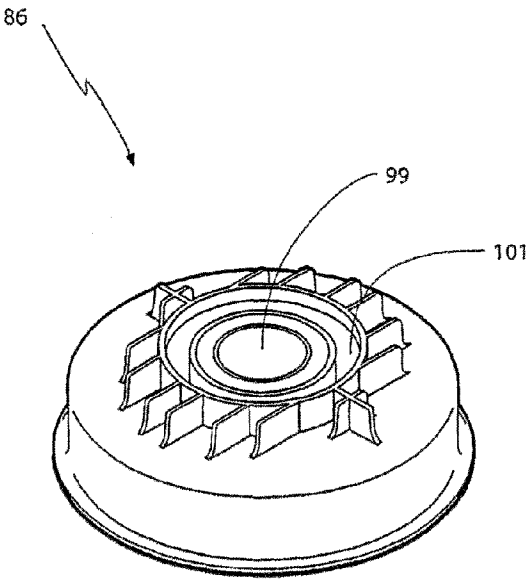
FIG. 8B is a schematic perspective view of a base part.

Initially, when a new sealed beverage container 68, is installed, the base part 86 is sealed off by a laminate sealing, as shown in FIG. 8B, at the outlet constriction 80. The laminate sealing is broken by the rod 74 when installing the beverage container 68. This allows beverage to be dispensed from the beverage container 68.

When the coupling housing 92, and thereby also the rod 74, is separated from the beverage container 68, the beverage, indicated by a shading FIG. 6, will exert a force on the ball-seal 76 pushing the ball-seal 76 against the outlet constriction 78 defining the closed position, i.e. the second passive position, thereby sealing off the beverage container 68.

In FIG. 6 the ball-seal 76 is positioned between the top seat 78 and the outlet constriction 80 allowing beverage to flow from the beverage container 68 past the ball-seal 76 and further through the beverage outlet 82 to the supply line 16, 18, 20 (shown in FIG. 1).

The beverage container 68 is fitted with the base part 86 wherein the top part of the dispensing valve 58 is received. The ball-seal 76, the top seat 78 and the outlet constriction 80 are components of the base part 86.

From the beverage dispensing position shown in FIG. 6 the rod 74 may be shifted towards the beverage container 68 or towards the beverage outlet 82. A spring 84 presses the rod 74 in the direction away from the beverage container 68 into the closed position. By the use of an appropriate compressed air pressure the spring 84 holds the rod 74 in the beverage dispensing position shown in FIG. 6. By use of a high compressed air pressure the rod 74 moves towards the beverage container 68 into the rinsing position further described in FIG. 7. The compressed air is delivered via the pneumatic valve 156, further described in connection with FIGS. 14-16.

FIG. 7 is a schematic cut-through, close-up view of the same assembly shown in FIG. 6, with the dispensing valve 58 slightly rotated around the vertical axis for disclosing a rinsing fluid inlet 90, which is not shown in FIG. 6, and the rod 74 in the rinsing position instead of the beverage dispensing position shown in FIG. 6. It is shown that the rinsing fluid inlet 90 is located at the coupling housing 92. The rinsing fluid inlet 90 is used for performing rinsing of the dispensing valve 58 and the supply line 16, 18, 20 (shown in FIG. 1). A rinsing fluid may be introduced via the rinsing fluid inlet 90 and rinses the space within the dispensing valve 58.

When the rod 74 is in the rinsing position, the ball-seal 76 is pushed into contact with the inlet constriction 78 so that a sealing effect is created ensuring that rinsing fluid does not enter the inside of the beverage container 68, which would contaminate the beverage stored in the beverage container 68.

When the rod 74, is in the rinsing position, i.e. in the first position as shown in FIG. 7, the ball-seal 76 and the top seat 78 establish a seal preventing rinsing fluid to enter the beverage container 68, however, allowing the rinsing fluid to flush and rinse the dispensing valve 58 and the supply line 16, 18, 20 (shown in FIG. 1 extending from the dispensing valve 58 towards the dispensing tap 10, 12, 14). By opening the dispensing tap 10, 12, 14 when the rod 74 is in the rinsing position, rinsing fluid will flow out of the dispensing tap and flush and rinse the dispensing valve 58 as well as the supply line and dispensing tap shown in FIG. 1.

The coupling housing 92 interconnects the outlet constriction 80 of the dispensing valve 58 and the beverage outlet 82. The rinsing fluid inlet 90 is attached to the coupling housing 92 as well, but in a position below a rinsing valve seat 96. When the rod 74 is in the rinsing position, a corresponding rinsing valve element 94 allows fluid communication between the rinsing fluid inlet 90 and the coupling housing 92. When the rod is moved away from the rinsing position to the dispensing position or the closed position the rinsing valve element 94 contacts the rinsing valve seat 96 and prevents fluid communication between the coupling housing 92 and the rinsing fluid inlet 90. This is to prevent beverage and rinsing fluid from mixing when the rod 74 is in the dispensing position.

After the rinsing process has ended, water is introduced through the rinsing fluid inlet 90 to flush the dispensing valve 58 and the supply line, so that residual rinsing fluid is not dispensed with the beverage in the first beverage dispensing operation after rinsing.

Figure 8A:
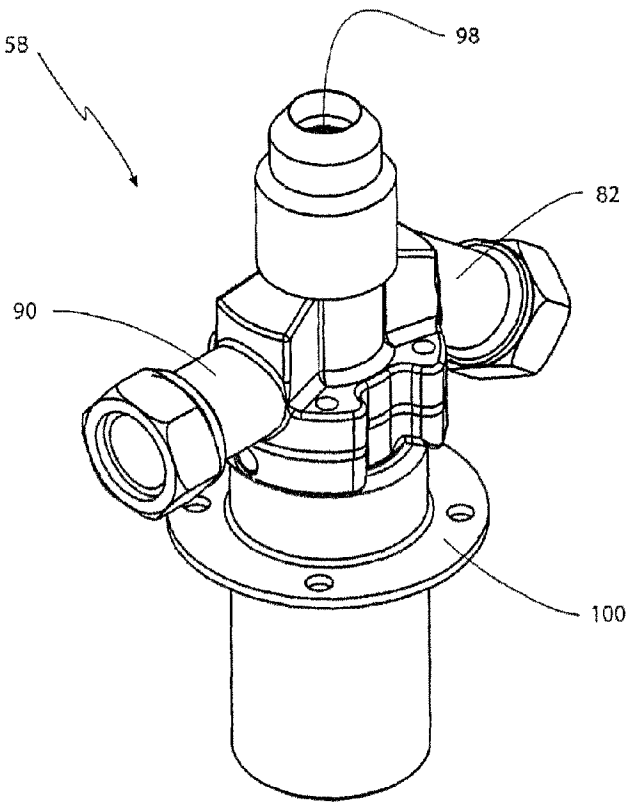
FIG. 8A is a schematic perspective view of a dispensing valve.

FIG. 8A schematically illustrates an exterior view of a dispensing valve 58 according to the present invention having a rinsing fluid inlet 90 and a beverage outlet 82.

The fitting 98 of the dispensing valve 58 is adapted for engaging the base part of a beverage container of the type shown in FIGS. 6, 7 as described above and in FIG. 10, which will be further described below. The dispensing valve 58 further comprises a fixation flange 100 extending radially from the dispensing valve 58. The fixation flange 100 may be used for securing the dispensing valve 58 to a wall of a module as shown in FIG. 1.

Figure 10:
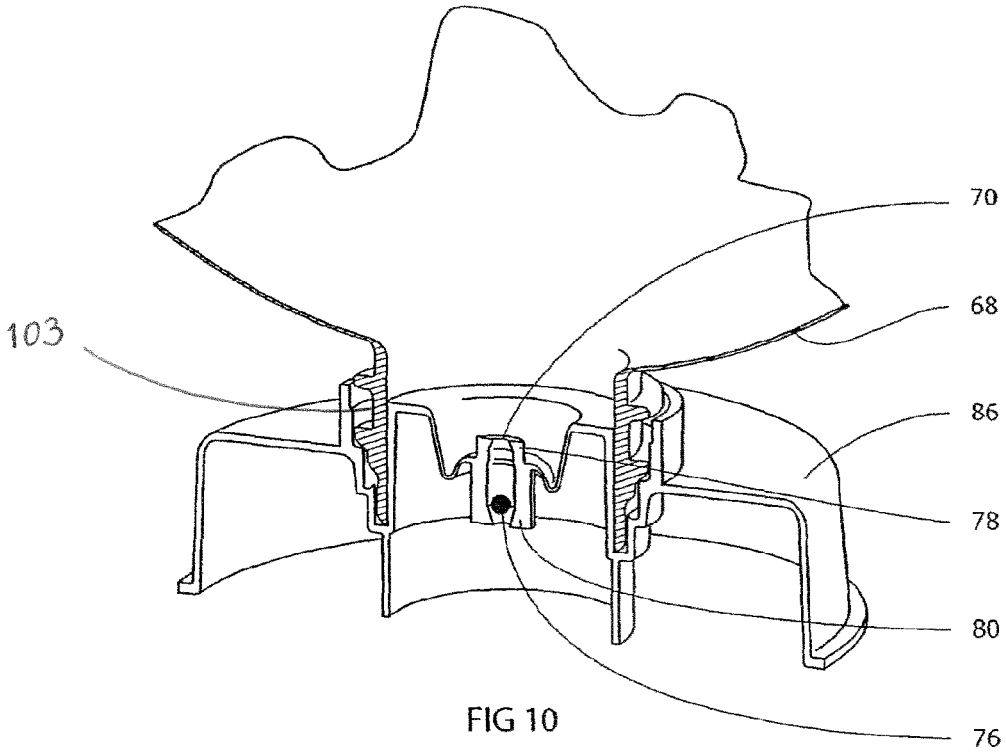
FIG. 10 is a schematic cut-through view of a beverage container with a ball-seal.

FIG. 8B schematically illustrates a base part 86 adapted to be secured to a beverage container of the type shown in FIGS. 6, 7 and 10. The base part 86 comprises a laminate sealing 99. Further the base part 86 comprises a recess 101 for receiving a neck 103 of a beverage container 68 of the type shown in FIGS. 6, 7 and 10. The neck 103 of the beverage container 68 engages the recess 101 such that a sealing effect is created and beverage is only able to pass through an opening in the laminate sealing 99. When the beverage container 68 of the type shown in FIGS. 6, 7 and 10 with the base part 86 is mounted in a pressure chamber as illustrated above, the rod 74 of the dispensing valve 58 as illustrated above pierces the laminate sealing 99, thereby establishing fluid communication between the interior of the beverage container and the dispensing valve 58.

Figure 9:
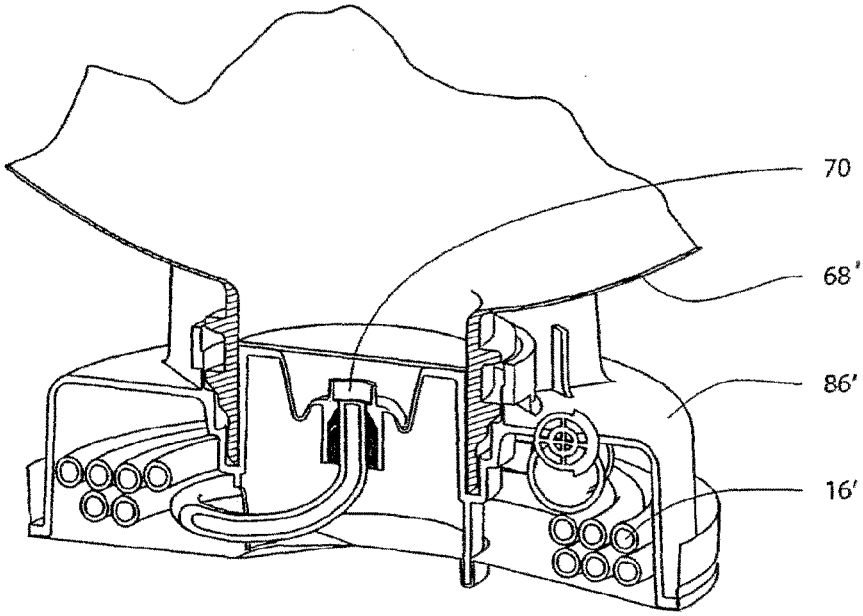
FIG. 9 is a schematic cut-through view of a beverage container with a supply line without dispensing valve.

FIG. 9 is a schematic view of a beverage container 68' of the type that may be used for a modular beverage distribution system. The beverage container 68' is compressible and/or collapsible as described above.

The beverage container 68' comprises a supply line 16' for establishing fluid communication with a dispensing tap of a beverage distribution system as described above in connection with FIG. 1. The supply line 16' is rolled up in the base part 86' during transportation, and may be unrolled when the beverage container 68' is installed in a pressure chamber 22, 24, 26 as described above.

The beverage container 68' described above may preferably be used without any dispensing valve 58. The supply line 16' may then be disposed together with the beverage container 68' and replaced by a new supply line 16' when installing a new beverage container 68'. This eliminates the need of cleaning the supply line 16'.

FIG. 10 is a schematic view of a beverage container 68, of a type that may be used for a modular beverage distribution system as described above. The beverage container 68 is compressible and/or collapsible also as described above. The beverage container 68 comprises a base part 86, which is adapted for receiving a dispensing valve 58, as described in relation to e.g. FIG. 8A and other figures described above. The dispensing valve 58 (not shown in FIG. 10) is received at the outlet constriction 80. The ball-seal 76 described in connection with FIG. 6 is included in the base part 86.

Figure 11:
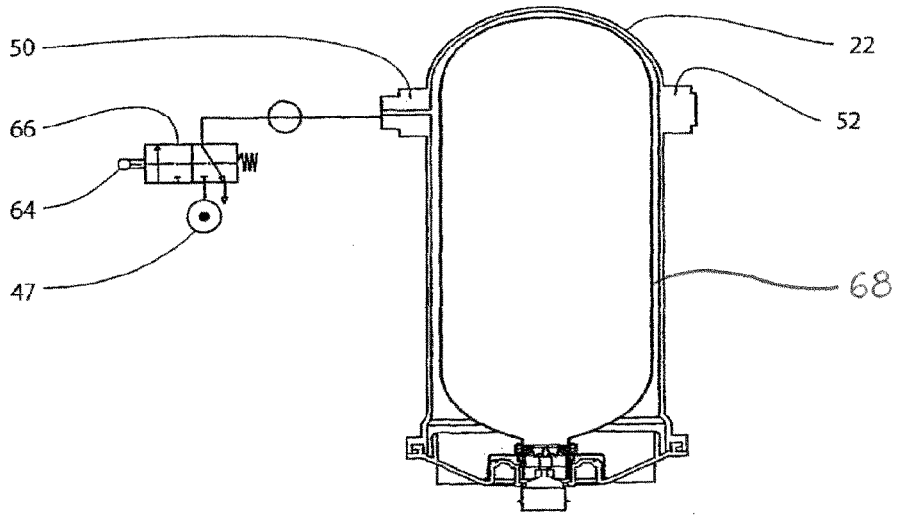
FIG. 11 is a schematic view of a module with direct pressure having a security valve but not a dispensing valve.

FIG. 11 is a schematic view of a module having direct pressure, i.e. the pressure fluid acts directly onto the beverage container 68. The module comprise a pressure chamber 22 wherein the beverage container 68 is received. The beverage container 68 is of the same type as the beverage container 68 shown in FIG. 9.

The set-up includes the security valve 66 which connects the pressure chamber with the fluid path 47 or the outside. The security valve 66 is ensuring that pressure is not supplied to the beverage container 68 when the pressure chamber 22 is pivoted into the substantially horizontal position as described above in relation to situations where the beverage container 68 is to be changed.

Pressure is supplied directly into the pressure chamber 22 to act with a force on the beverage container 68 for dispensing the beverage stored therein.

When the beverage container 68 is to be changed, the pressure gas, e.g. air, stored in the pressure chamber 22 is released via the security valve 66 such that the beverage container 68 may be removed and replaced. This gas release may be made automatically when pivoting the pressure chamber 22.

Figure 12:
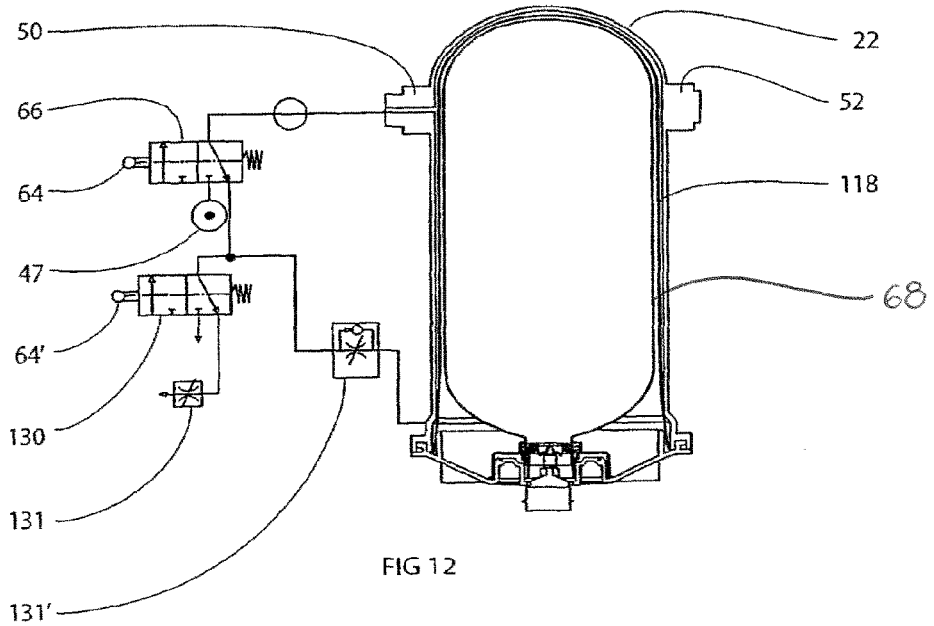
FIG. 12 is a schematic view of a module with indirect pressure having a security valve and a release valve but not a dispensing valve.

FIG. 12 is a schematic illustration of a module having indirect pressure, i.e. the pressure fluid such as air is supplied into the pressure chamber 22 between the inner wall of the pressure chamber 22 and a liner 118 preferably comprising a membrane made of plastic or rubber. As the pressure increases and the beverage is dispensed, the liner 118 and the beverage container 68 collapse. The beverage container 68 is of the type shown in FIG. 9. The plastic or rubber liner 118 is positioned between the beverage container 68 and the inner wall of the pressure chamber 22.

In addition to the security valve 66, a release valve 130 is present. The release valve connects the space between the liner 118 and the beverage container 68 to the outside when the pressure chamber 22 is in the vertical orientation. When the beverage container 68 is to be replaced and the pressure chamber is pivoted into the horizontal position, the security valve 66 is switched from its first position connected to the fluid path 47 to a second position where the gas stored between the inner wall of the pressure chamber 22 and the liner 118 is lead via the release valve 130 into the volume between the liner 118 and the beverage container 68. At the same time the release valve connects both the space between the inner wall of the pressure chamber 22 and the liner 118 and the space between the liner and the beverage container via a flow restrictor 131 to the outside. The flow restrictor 131 allows the pressure to be released slowly. A controllable flow restrictor 131' may be additionally provided between the release valve and the pressure chamber 22. To make the liner 118 return to its original position at the inner wall of the pressure chamber 22 it is typically sufficient to simply release or pump out the gas.

Figure 13:
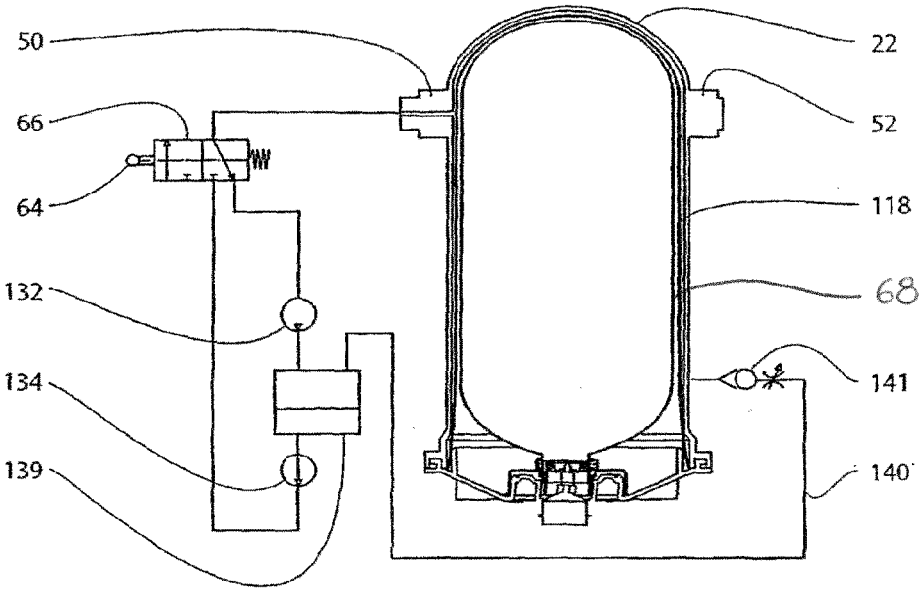
FIG. 13 is a schematic view of a module with hydraulic pressure without a dispensing valve.

FIG. 13 is a schematic illustration of a module having indirect hydraulic pressure. The beverage container 68 is received within the pressure chamber 22. The beverage container 68 is of the type shown in FIG. 9. A plastic or rubber liner 118 is disposed between the inner wall of the pressure chamber 22 and the beverage container 68.

Pressurised liquid such as water, or preferably a liquid coolant, is supplied into the pressure chamber 22 between the inner wall of the pressure chamber 22 and the plastic liner 118. As the pressure increases and the beverage is dispensed, the liner 118 and the beverage container 68 will collapse. The liquid is supplied from a reservoir 139. A hydraulic inlet pump 134 is used to supply pressurized liquid from the reservoir 139 via the security valve 66 to the pressure chamber 22, and a hydraulic outlet pump 132 is used to transport the liquid from the pressure chamber 22 via the security valve 66 back to the reservoir 139. When the pressure chamber 22 is positioned in the vertical position the security valve 66 allows pressurized liquid to flow from the hydraulic inlet pump 134 into the pressure chamber. When the pressure chamber 22 is pivoted from the vertical position to the horizontal position the security valve 66 instead allows the pressurized fluid to be pumped back to the reservoir 139.

In addition to the security valve 66 for supplying pressure liquid to the pressure chamber 22, a variable flow control valve 141 and a return line 140 for allowing the pressurized liquid to flow from the pressure chamber 22 to the reservoir 139 are present. The variable flow control valve 141 may e.g. be set to a specific flow or pressure depending on the maximum pressure supplied. As described above a pressure limiting device may be used, which device may limit the pressure supplied to the pressure chamber 22 to e.g. 3 bar, the variable flow control valve 141 may then be set to e.g. 2.5 bar and allow pressurized fluid to flow through the pressure chamber 22 to cool the beverage in the beverage container 68.

In a specific embodiment each module in the beverage distribution system may have a separate reservoir 139 and separate hydraulic pumps 132 134. The hydraulic pumps may then be driven by compressed air, supplied by the modular fluid path as described in FIGS. 11-12.

In an alternative embodiment, a common reservoir 139 and common supply pumps 132 134 are used. This requires a common hydraulic inlet line, a common hydraulic outlet line and a common return line to be assembled in a modular way similar to the fluid path in the previous embodiments.

Figure 14:
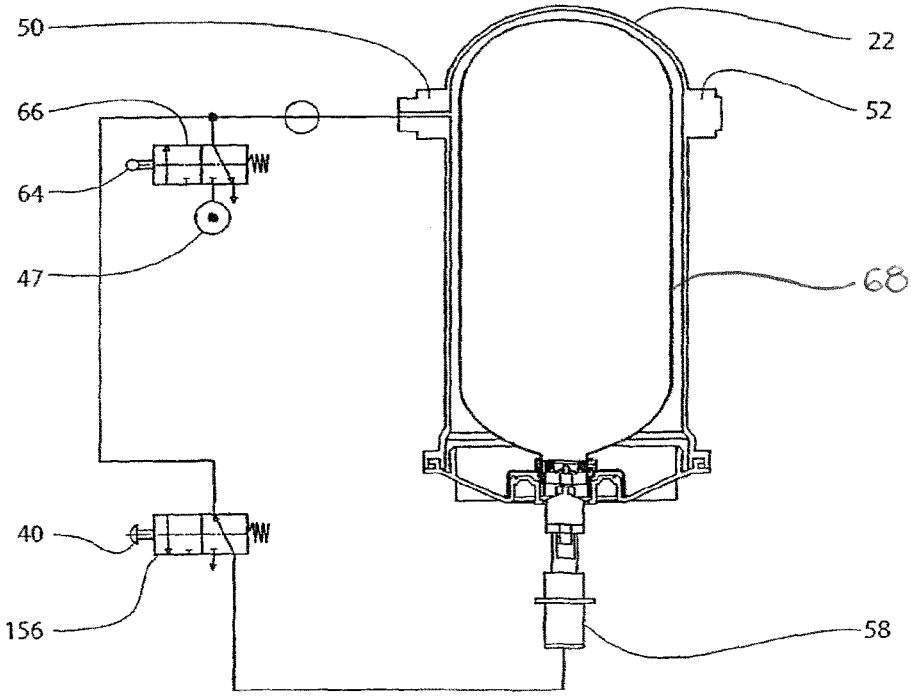
FIG. 14 is a schematic view of a module with direct pressure having a security valve and a dispensing valve.
Figure 15:
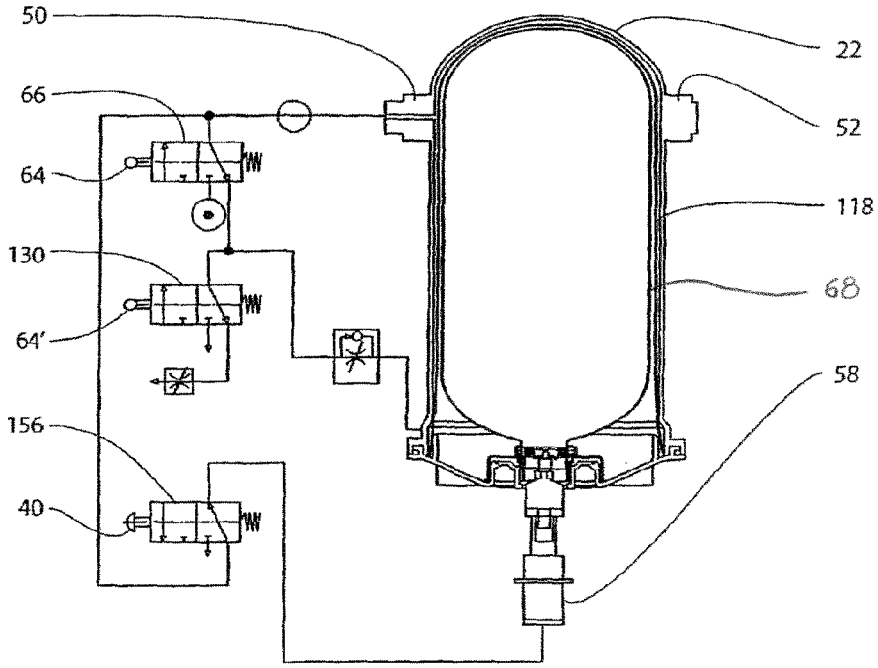
FIG. 15 is a schematic view of a module with indirect pressure having a security valve, a release valve and a dispensing valve.
Figure 16:
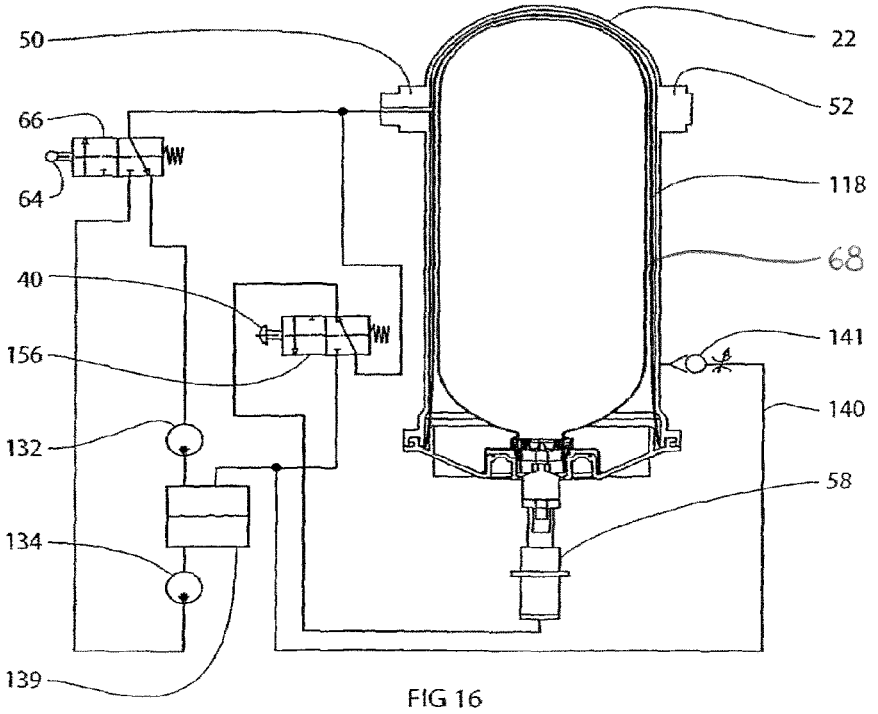
FIG. 16 is a schematic view of a module with hydraulic pressure and a dispensing valve.

FIGS. 14, 15 and 16 are embodiments of pressure chambers 22 with setups largely identical to those illustrated in FIGS. 11, 12 and 13, respectively, however, unlike the previous three embodiments the following three embodiments make use of the dispensing valve 58 as described previously in FIGS. 5-8.

In the embodiments shown in FIGS. 14, 15 and 16 modules similar to those shown in FIG. 10 are used. The dispensing valve 58 is controlled by the pneumatic valve 156 and functions in the way described above in relation to FIGS. 5-8. The pneumatic valve 156 is pressurized when the pressure chamber is in the vertical position and the security valve will supply pressure fluid. When the button 40, shown in FIGS. 1-4, is pressed in a first position, a low pressure is supplied to the dispensing valve for the dispensing valve to assume the beverage dispensing position. When the button 40, shown in FIGS. 1-4, is pressed in a second position, a high pressure is supplied to the dispensing valve for the dispensing valve to assume the rinsing position. When the pressure chamber is in the horizontal position the pneumatic valve 156 is connected to the outside through the security valve, thus the dispensing valve will assume the closed position.

Figure 17B:
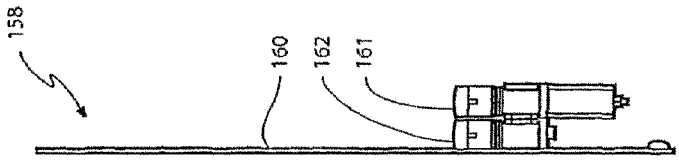
FIG. 17B is schematic left side view of the pressure guarding unit of FIG. 17A.
Figure 17C:
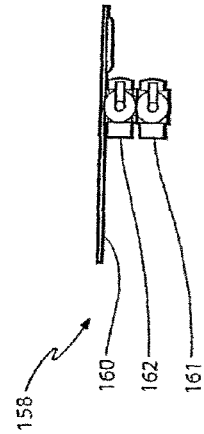
FIG. 17C is a top view of the pressure guarding unit of FIG. 17A.
Figure 17A:
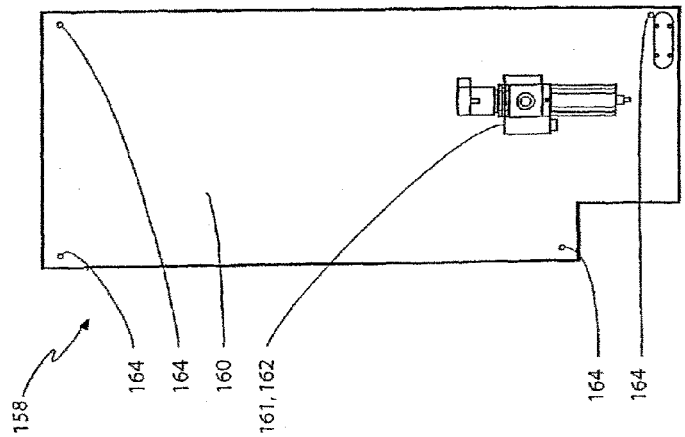
FIG. 17A is a schematic front view of a pressure guarding unit.

FIGS. 17*a*, 17*b* and 17*c* are schematic illustrations of a pressure guarding unit 158. The pressure guarding unit 158 comprises a wall plate 160 for mounting the pressure guarding unit 158 on the side of a module of the type as described above in relation to FIGS. 1-5 for storing a pressure chamber of the type as described above in relation to FIGS. 1-5 and 11-16.

The pressure guarding unit 158 comprises a pressure fluid limiter, which is intended to be mounted between a pressure generator and a pressure receiver, e.g. a pressure inlet of a module including a pressure chamber as described previously in connection with FIGS. 1-5 for limiting the pressure level in the pressure chamber. The pressure limit is in one embodiment according to the present invention set to 3 bar. The pressure limit may be set differently depending on the type of pressure chamber. It is contemplated that some types of pressure chambers may withstand higher pressures than others, the limit may therefore vary.

The pressure guarding unit 158 includes a first interface connector 161 for connecting to a pressure fluid source, e.g. a pump and a pressure fluid line, and a second interface connector 162. The second interface connector 162 is adapted for establishing a coupling to a pressure inlet of a module, either direct or indirect, e.g. via a tube or channel.

The wall plate 160 includes mounting holes 164 for securing the wall plate 160 to a sidewall of a module.

Figure 18:
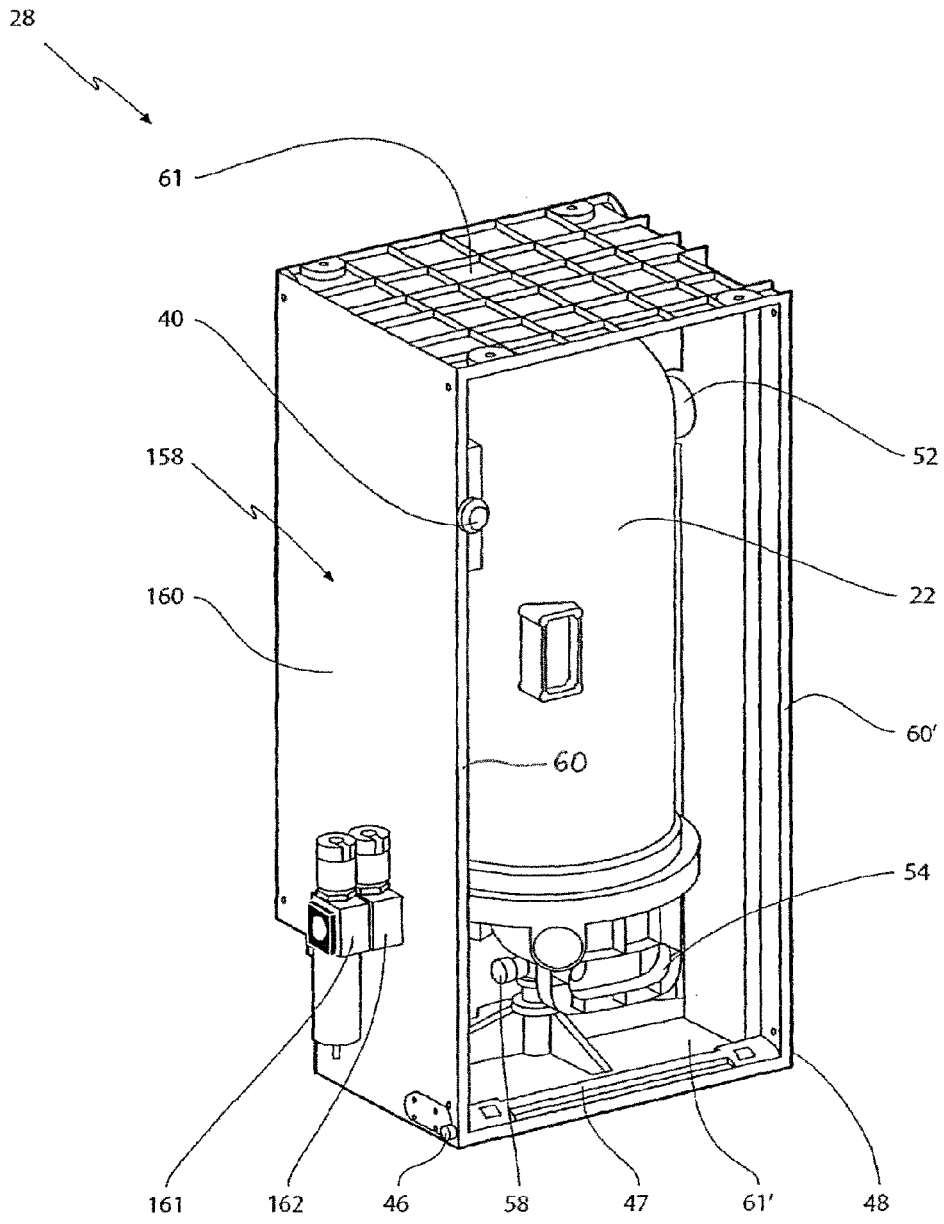
FIG. 18 is a perspective schematic view of a module with a pressure guarding unit and a pressure chamber.

FIG. 18 schematically illustrates a perspective view of the pressure guarding unit 158 of FIG. 17 being attached to the module 28. When the pressure guarding unit 158 is attached to the sidewall 60 of the module 28, fluid communication is established from the pressure guarding unit 158 to the pressure chamber 22 so that the pressure supplied to the pressure inlet 46 of the module 28 and any further modules making up the beverage distribution system, is limited to a given maximum. As stated above the currently preferred limit is 3 bar.

A plurality of modules as shown in FIGS. 2, 3, 4 and 5 may be assembled together with a pressure guarding unit 158 as shown in FIGS. 17A, 17B and 17C to form a beverage distribution system for dispensing beverages in a safe and easy manner.

Figure 19:
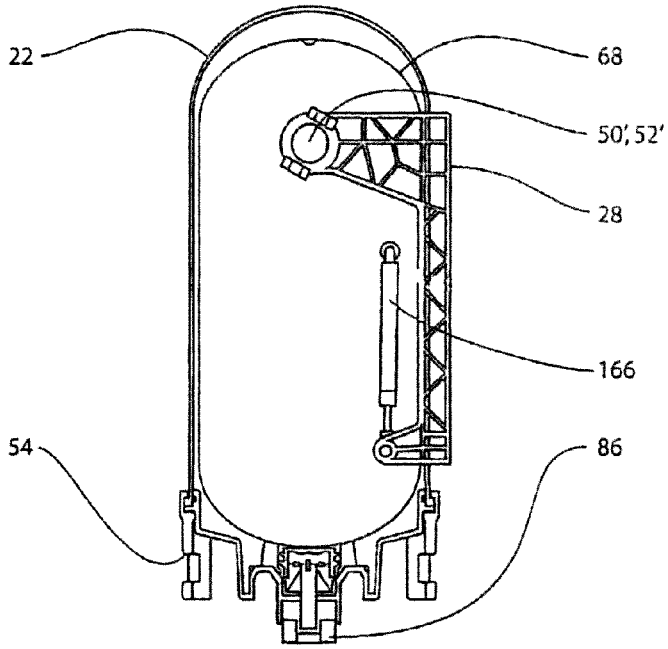
FIGS. 19 and 20 are schematic side views of a pivotally mounted pressure chamber.
Figure 20:
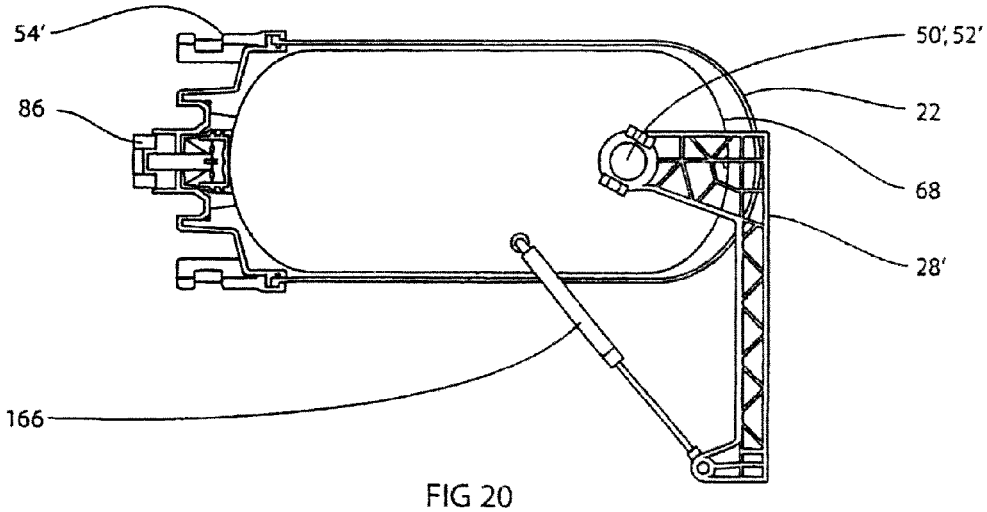

FIGS. 19 and 20 are schematic side views illustrating the journaling of the pivotally mounted pressure chamber 22 relative to the side wall constituting a rear wall 60" of the frame of the module 28. The pressure chamber 22 includes the collapsible beverage container 68.

The pressure chamber 22 is attached to the rear wall 60" of the module 28 through a left-hand journal 50' and a right-hand journal 52', which are perpendicular connected to the rear wall 60". A pair of gas cylinders 166 pivotally connected between the pressure chamber 22 and the rear wall 60" allows the pressure chamber 22 to remain in the horizontal position shown in FIG. 20. In FIG. 19 the pressure chamber 22 is shown in the vertical position, in which beverage stored in the beverage container 68 may be dispensed.

It should be noted that the embodiment shown in FIGS. 19-20 may constitute a part of the previously described modules 28 or alternatively it may constitute a wall-hung module. A wall-hung module is preferably used together with a corresponding rail system mounted on the wall of the establishment and preferably in combination with other wall-hung modules to form a modular beverage distribution system.

Figure 21:
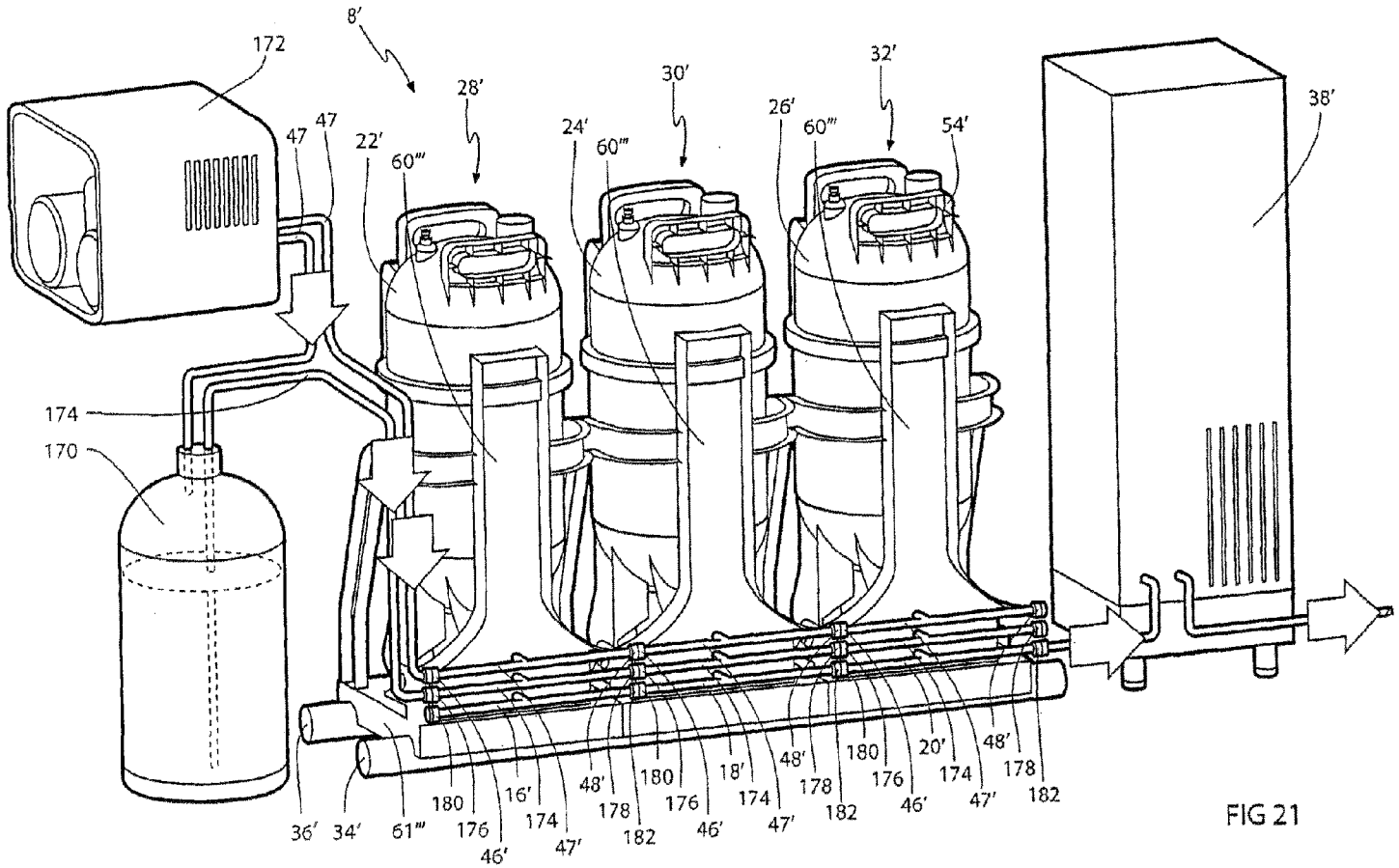
FIG. 21 is a rear view of a further embodiment of a modular beverage dispensing system having a rinsing fluid line.

FIG. 21 shows a further embodiment of a modular beverage distribution system 8' for use with a dispensing valve 58 as shown in FIGS. 6-7. The modular beverage distribution system 8' comprises three modules 28', 30', 32' each mounted to a bottom wall 61'" and a rear wall 60'" constituting a frame 60'", 61'". The bottom wall 61'" rests on a mounting rack constituting a support 34', 36'. The three modules 28', 30', 32' are mounted in series on the support.

Each of the modules 28', 30', 32' comprises a supply line 16', 18', 20', a rinsing and a fluid path 47'. The supply line 16', 18', 20', the rinsing line 174 and the fluid path 47' are mounted near the bottom wall 61'" of each module. Each module 28', 30', 32' comprises for each of the above mentioned lines 16', 18', 20', 174, 47' an inlet (not shown) constituting a first type connector, an outlet (not shown) constituting a second type connector, and a branch pipe (not shown) constituting a third type connector. The branch pipe leads to the dispensing valve of each module. The outlets of the first module 28' are directly connected to the inlets of the second module 30' and the outlets of the second module 30' are directly connected to the inlets of the third module 32'.

The rinsing line 174 of the first module 28' is connected to a rinsing fluid container 170, which is filled with rinsing fluid, via a rinsing line inlet 176. A pressure generator 172 pressurizes the rising fluid container 170 to allow rinsing fluid to flow from the rinsing container 170 to the first module 28'. The rinsing line 174 is connected to a rinsing fluid inlet 90 of the dispensing valve 58 as shown in connection with FIG. 7. The rinsing line inlet is further connected via the rinsing line 174 to a rinsing line outlet 178, which is connected to a rinsing line inlet 176 of a further module 30'. The rinsing line outlet 178 of the last module 32' is left without connection and has a check valve to prevent leakage of rinsing fluid.

The fluid path 47' of the first module 28' is connected directly to the pressure generator 172 via a pressure inlet 46'. The fluid path 47' is connected to the pressure chamber 22' via a security valve (not shown). The fluid path 47' is connected to a pressure inlet 46' of a further module 30' via a pressure outlet 48'. The fluid path 47' may also provide driving pressure to the valve 58 which is shown in FIGS. 6-7. The pressure outlet 48' of the last module 32' is left without connection but has a check valve (not shown) to avoid pressure fluid escaping.

The supply line inlet 180 of the first module 28' is left without connection, however a check valve (not shown) is provided to prevent beverage to flow out through the supply line inlet 180 of the first module 28'. The supply line inlet 180 of the first module 28' is connected to a supply line 16', which is connected to a supply line 18' of a further module 30' via a supply line outlet 182 of the module 28' and the supply line inlet 180 of module 30'. The supply line 18' is similarly connected to a supply line 20' of the third module 32'. The supply line outlet 182 of the supply line 20' of the third module 32' is connected via a cooling system 38' to the tapping unit as shown in FIG. 1 and designated by reference numerals 10, 12, 14. Each supply line 16', 18', 20' is connected to a beverage outlet 82 of the dispensing valve 58 as shown in FIGS. 6-7.

Figure 22:
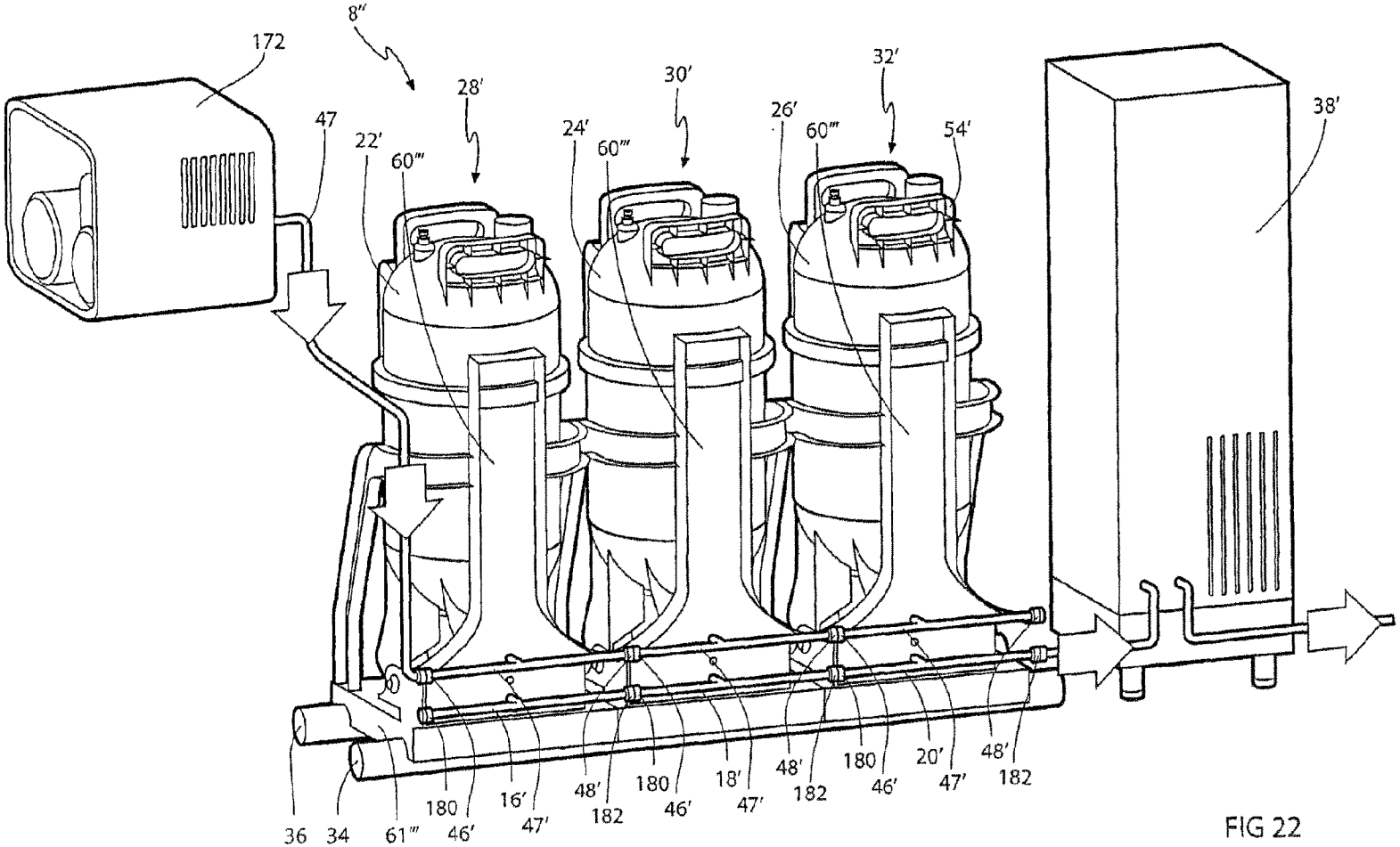
FIG. 22 is a rear view of a further embodiment of a modular beverage dispensing system without a rinsing fluid line.

FIG. 22 shows a further embodiment of a modular beverage distribution system 8" similar to the previous embodiment described in FIG. 21. The beverage distribution system 8" however lacks the rinsing fluid reservoir and line, and is consequently designed to be used with a dispensing valve without rinsing fluid inlet.

Figure 23:
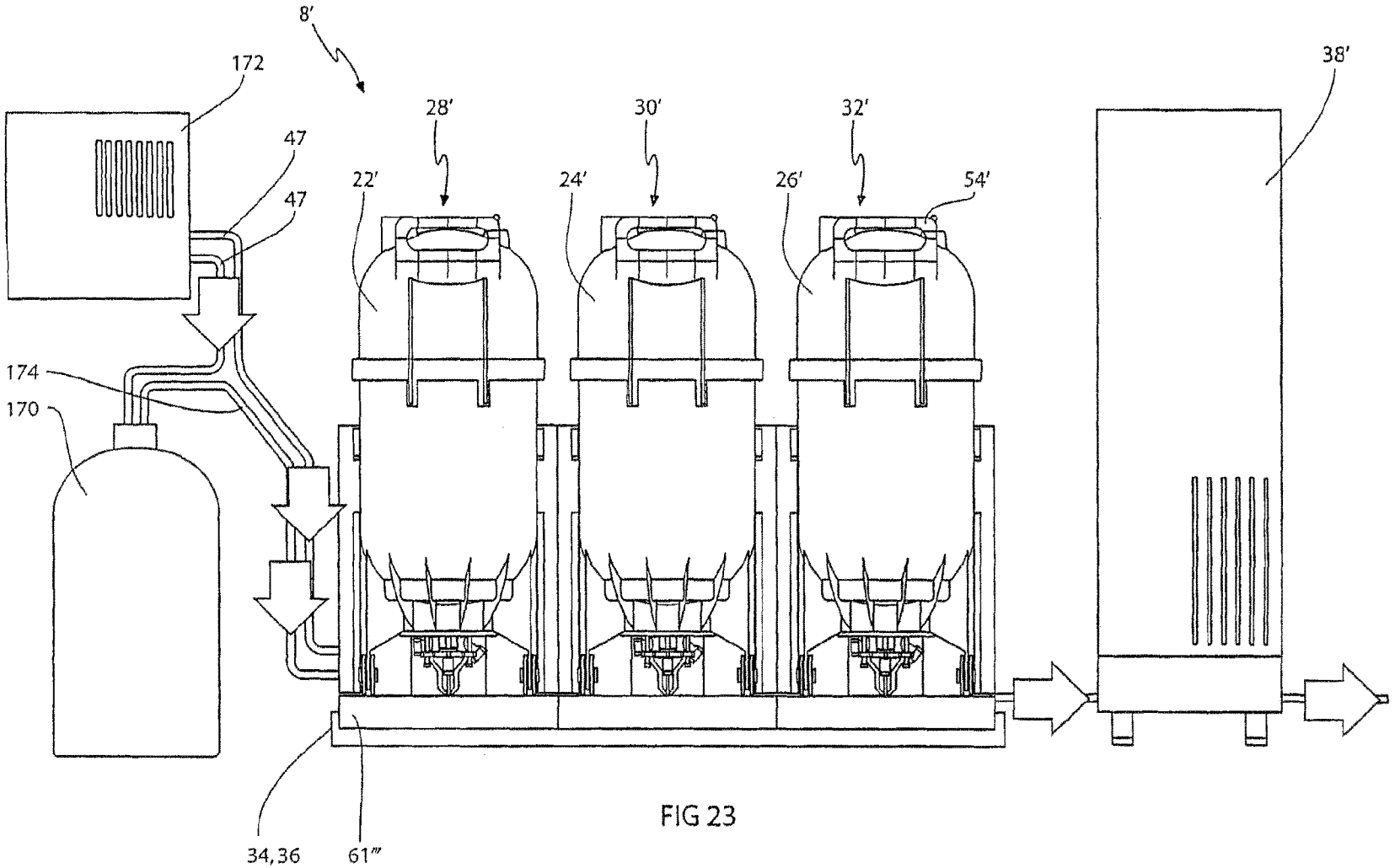
FIG. 23 is a front view of a modular beverage dispensing system.

FIG. 23 shows a front view of the beverage distribution system 8' of FIG. 21.

Figures 24A, 24B:
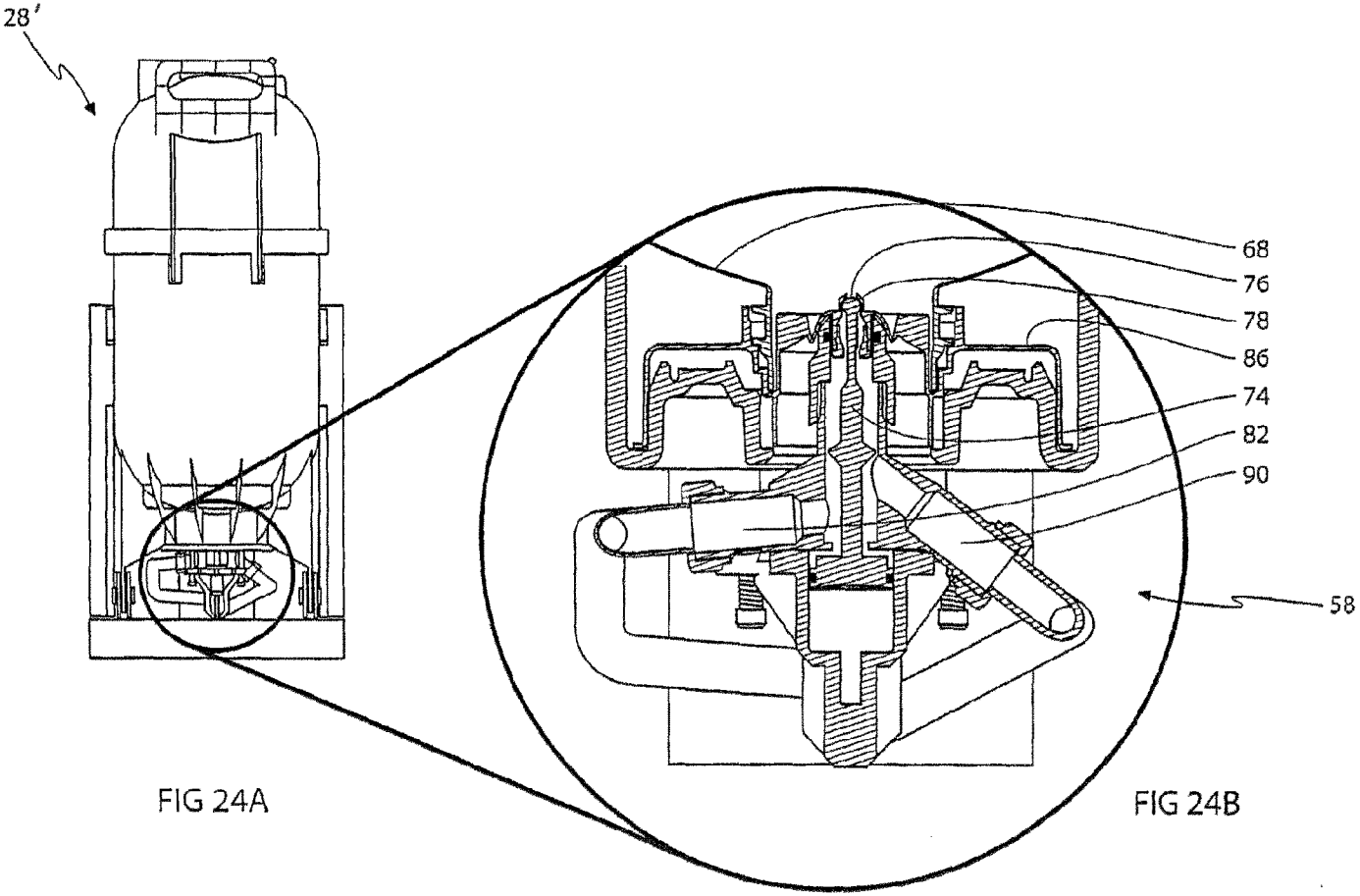
FIG. 24A is a front view of a module of a modular beverage dispensing system.
FIG. 24B is a zoomed view of the dispensing valve of the module of FIG. 24A.

FIG. 24A shows a front view of a module 28' of the beverage distribution system 8'. FIG. 24B shows a zoomed view of the dispensing valve 58, which corresponds to the dispensing valve described in connection with FIGS. 6-7.

Throughout the description of the drawings reference has been made to the pressure fluid as either air or water, but other suitable fluids may be used.

The pressure chamber has been described as made from a plastic or polymer material, but a person skilled in the art may easily recognise that other suitable materials may be used, e.g. metallic materials, such as steel or even lighter metallic materials, such as aluminium.

The walls making up the frame (60, 60', 61, 61', 60", 60'", 61') may be made from plastic material or metallic material or any other suitable material.

Other variations of the mentioned components and materials may be contemplated by a person skilled in the art, and are also to be considered within the scope of the present invention.

List of parts with reference to the figures

| | |
|---|---|
| 8. | Beverage distribution system |
| 10, 12, 14. | Dispensing tap |
| 16, 18, 20. | Supply line |
| 22, 24, 26. | Pressure chamber |
| 28, 30, 32. | Module |
| 34, 36 | Support |
| 38. | Cooling system |
| 40, 42, 44 | Button |
| 46. | Pressure inlet |
| 47. | Fluid path |
| 48. | Pressure outlet |
| 50. | Left-hand journal |
| 52. | Right-hand journal |
| 54. | Handle |
| 58. | Dispensing valve |
| 60. | Sidewall/Rearwall |
| 61. | Top/bottom wall |
| 62. | Flange |
| 64. | Security switch |
| 66. | Security valve |

-continued

List of parts with reference to the figures

| | |
|---|---|
| 68. | Beverage container |
| 70. | Opening |
| 74. | Rod |
| 76. | Ball-seal |
| 78. | Inlet constriction |
| 80. | Outlet constriction |
| 82. | Beverage outlet |
| 84. | Spring |
| 86. | Base part |
| 88. | Pressure lid |
| 90. | Rinsing fluid inlet |
| 92. | Coupling housing |
| 94. | Rinsing valve element |
| 96. | Rinsing valve seat |
| 98. | Fittings |
| 99. | Laminate sealing |
| 100. | Fixation flange |
| 101. | Rim |
| 118. | Liner |
| 130. | Release valve |
| 131. | Flow restrictor |
| 132. | Hydraulic inlet pump |
| 134. | Hydraulic outlet pump |
| 139. | Reservoir |
| 140. | Return line |
| 141. | Variable flow control valve |
| 156. | Pneumatic valve |
| 158. | Pressure guarding unit |
| 160. | Wall plate |
| 161. | First interface connector |
| 162. | Second interface connector |
| 164. | Mounting holes |
| 166. | Gas cylinder |
| 170. | Rinsing fluid container |
| 172. | Pressure generator |
| 174. | Rinsing line |
| 176. | Rinsing line inlet |
| 178. | Rinsing line outlet |
| 180. | Supply line inlet |
| 182. | Supply line outlet |

In the above description and in the figures the reference (') denotes a different embodiment of the same part.

The invention claimed is:

1. A module (28) for a modular beverage distribution system (8) comprising the module (28) and first and second neighboring modules, the module (28) comprising:

a frame (60, 60', 61, 61') defining an outer periphery and a space defined within said outer periphery;

a pressure chamber (22) for receiving a beverage container (68), said pressure chamber 22 arranged within said space;

an inlet connector (46) of the module (28) and an outlet connector (48) of the module (28) positioned at said outer periphery, a fluid path (47) establishing fluid communication from said inlet connector (46) of the module (28) to said outlet connector (48) of the module (28), said inlet connector (46) of the module (28) connectable to a further outlet connector (48) of the first neighboring module, said inlet connector (46) of the module (28) adapted to receive a pressure-fluid from a pressure-fluid source, said outlet connector (48) of the module (28) adapted to transfer said pressure-fluid to a further first type connector (46) of the second neighboring module; and a pressure chamber connector (66) of the module (28) in fluid communication with said inlet connector (46) of the module (28) and supplying said pressure-fluid from said inlet connector (46) of the module (28) to said pressure chamber (22).

2. The module (28) according to claim 1, wherein:

said frame comprises a first sidewall (60) and a parallel second sidewall (60)' each sidewall (60, 60') defining a top and a respective bottom;

said parallel sidewalls (60, 60') are interconnected by two parallel endwalls 61, 61' interconnecting said top of said first sidewall (60) with said top of said second sidewall (60') and said bottom of said first sidewall (60) with said bottom of said second sidewall (60)' respectively, said two parallel sidewalls (60, 60') and said two parallel endwalls 61, 61' defining said outer periphery and a corresponding inner periphery; and said pressure chamber connector (66) of the module (28) is positioned at said inner periphery.

3. The module (28) according to claim 1, wherein:

said frame comprises a sidewall (60) and a bottom endwall (61') oriented perpendicular to said sidewall;

said sidewall (60) defines a top and a respective bottom, said bottom endwall defining a near end and a distant end;

said bottom of said sidewall (60) is connected to said near end of said bottom endwall 61;

said endwall defines a near end and a distant end, said sidewall (60) and said endwall 61 defining said outer periphery and a corresponding inner periphery, said space being defined between said sidewall (60) and said bottom endwall; and said pressure chamber connector (66) of the module (28) is positioned at said inner periphery.

4. The module (28) according to claim 1, wherein said pressure chamber connector (66) of the module (28) further is in fluid communication with said outlet connector (48) of the module (28).

5. The module (28) according to claim 1, wherein said beverage container (68) is replaceable.

6. A modular beverage distribution system (8) comprising a plurality of modules (28, 30, 32), wherein each module (28, 30, 32) comprises:

a frame (60, 60', 61, 61') defining an outer periphery and a space defined within said outer periphery;

a pressure chamber (22) configured for receiving a beverage container (68) containing a liquid, said pressure chamber (22) arranged within said space;

an inlet connector (46) and an outlet connector (48) positioned at said outer periphery, a fluid path (47) establishing fluid communication from said inlet connector (46) to said outlet connector (48), said inlet connector (46) connectable to a further outlet connector (48) of a first other module of the plurality of modules, said inlet connector (46) adapted to receive a pressure-fluid from a pressure-fluid source, said outlet connector (48) adapted to transfer said pressure-fluid to a further inlet connector (46) of a second other module of the plurality of modules, and a pressure chamber connector (66) in fluid communication with said inlet connector (46) and supplying said pressure-fluid from said inlet connector to said pressure chamber (22);

wherein a pressure distribution path (47) is defined from the pressure fluid source through each of the modules of said plurality of modules (28, 30, 32);

and wherein said pressure-fluid source comprises a pressure generator, said pressure generator being in fluid communication with a first module of said plurality of modules (28, 30, 32) via an inlet connector (46) of said first module, said pressure generator delivering said pressure-fluid to said first module.

7. The beverage distribution system (8) according to claim 6, wherein said frame (60, 60', 61, 61') comprises:

a first sidewall (60) and a parallel second sidewall (60'), each sidewall (60, 60') defining a top and a respective bottom, said parallel sidewalls (60, 60') interconnected by two parallel endwalls (61, 61') interconnecting said top and said bottom of said first sidewall (60) with a respective top and bottom of said second sidewall (60'), said two parallel sidewalls (60, 60') and said two parallel endwalls (61, 61') defining said outer periphery and a corresponding inner periphery; and said pressure chamber connector (66) positioned at said inner periphery.

8. The beverage distribution system (8) according to claim 6, wherein:

said frame comprises a sidewall (60) and a bottom endwall (61') oriented perpendicular to said sidewall;

said sidewall (60) defines a top and a respective bottom, said bottom endwall defining a near end and a distant end;

said bottom of said sidewall (60) is connected to said near end of said bottom endwall (61);

said endwall defines a near end and a distant end, said sidewall (60) and said endwall 61 defining said outer periphery and a corresponding inner periphery, said space being defined between said sidewall (60) and said bottom endwall; and said pressure chamber connector (66) is positioned at said inner periphery.

9. The beverage distribution system (8) according to claim 6, wherein the modules (28, 30, 32) of said plurality of modules (28, 30, 32) are arranged so that the top of said outer periphery of each module of said plurality of modules (28, 30, 32) is substantially flush.

10. The beverage distribution system (8) according to claim 6, wherein said modules (28, 30, 32) are arranged so that said pressure fluid is delivered from said pressure generator to said first module at said inlet connector (46) of said first module, said pressure fluid being distributed to the second other module via said outlet connector (48) of said first module to the further inlet connector (46) in said first other module.

11. The beverage distribution system (8) according to claim 6, wherein said beverage container (68) is a flexible bag and said flexible bag is compressible by said pressure-fluid causing said liquid stored in said bag to be dispensed.

12. The beverage distribution system (8) according to claim 6, wherein said pressure-fluid is further used as a cooling agent for cooling said liquid in said beverage container (68).

13. The beverage distribution system (8) according to claim 6, wherein said beverage distribution system further comprises a dispensing line 16 in fluid communication with said beverage container (68), said dispensing line (16) being in fluid communication with a dispensing unit (10) for selectively dispensing said liquid.

14. The beverage distribution system (8) according to claim 6, wherein said beverage distribution system further comprises a dispensing line for each of said beverage containers, said dispensing line being in fluid communication with a respective beverage container, each of said dispensing lines being in fluid communication with a respective dispensing unit for selectively dispensing said liquid.

15. The beverage distribution system (8) according to claim 6, wherein said pressure chamber (22) is pivotally mounted in said frame (60, 60', 61, 61'), said pressure chamber (22) being operable from a first state to a second state, said first state being a dispensing state where said pressure chamber is positioned substantially vertical and in fluid communication with said pressure chamber connector (66), said second state being a position where said pressure chamber is in a substantially horizontal position.

16. The beverage distribution system (8) according to claim 15, wherein said pressure chamber (22) operates a switch controlling a valve at said pressure chamber connector (66) so that when said pressure chamber (22) is in said first state said valve is open and when said pressure chamber (22) is operated away from said first state, said valve is closed.

17. The beverage distribution system (8) according to claim 6, wherein said beverage container (68) is rotatably mounted in said pressure chamber (22).

18. The beverage distribution system (8) according to claim 6, wherein said pressure chamber includes a membrane (118) positioned between the inner wall of said pressure chamber (22) and said beverage container (68), so that said pressure fluid acts on said membrane (118) and pressure is transferred onto the surface of said beverage container (68).

19. The beverage distribution system (8) according to claim 6, wherein said pressure-fluid is delivered at a pressure that is limited to a specific maximum pressure.

20. The beverage distribution system (8) according to claim 6, wherein at least one of said pressure distribution path (47) and said dispensing line (16) is defined through all of the modules (28, 30, 32) of said plurality of modules (28, 30, 32) as a coupling/connection selected from the group consisting of a series coupling/connection, a parallel coupling/connection, and a matrix coupling/ connection.

* * * * *

UNITED STATES PATENT AND TRADEMARK OFFICE

CERTIFICATE OF CORRECTION

PATENT NO. : 8,479,955 B2
APPLICATION NO. : 12/674358
DATED : July 9, 2013
INVENTOR(S) : Steen Vesborg et al.

It is certified that error appears in the above-identified patent and that said Letters Patent is hereby corrected as shown below:

In the Specification

In column 9, line 1, delete "Inbetween" and insert -- In-between --, therefor.

In column 18, line 37, delete "rinsing" and insert -- rinsing line 174 --, therefor.

Signed and Sealed this
Nineteenth Day of November, 2013

Teresa Stanek Rea

Teresa Stanek Rea
*Deputy Director of the United States Patent and Trademark Office*